United States Patent [19]

Walker

[11] 4,126,183

[45] Nov. 21, 1978

[54] OFFSHORE WELL APPARATUS WITH A PROTECTED PRODUCTION SYSTEM

[75] Inventor: Raymond W. Walker, Huntington Beach, Calif.

[73] Assignee: Deep Oil Technology, Inc., Long Beach, Calif.

[21] Appl. No.: 749,159

[22] Filed: Dec. 9, 1976

[51] Int. Cl.[2] ..... E21B 7/12

[52] U.S. Cl. ..... 166/338; 166/337; 166/364; 166/72

[58] Field of Search ..... 166/0.5, 0.6, 72, 315; 175/7; 61/86, 87, 110, 112; 114/264, 265; 9/8 P

[56] References Cited

U.S. PATENT DOCUMENTS

| | | | |
|---|---|---|---|
| 3,142,343 | 7/1964 | Otteman et al. | 166/0.5 X |
| 3,142,344 | 7/1964 | Otteman et al. | 166/0.5 X |
| 3,196,958 | 7/1965 | Travers et al. | 166/0.5 X |
| 3,326,285 | 6/1967 | Coberly | 166/0.6 |
| 3,330,339 | 7/1967 | Johnson | 166/0.6 |
| 3,411,576 | 11/1968 | Taylor | 166/0.5 |
| 3,592,263 | 7/1971 | Nelson | 166/0.5 |
| 3,602,319 | 8/1971 | Graham et al. | 166/0.5 |
| 3,625,281 | 12/1971 | Herd et al. | 166/0.5 |
| 3,729,756 | 5/1973 | Cook et al. | 166/0.5 X |
| 3,739,844 | 6/1973 | Peterman et al. | 166/0.5 |
| 3,780,685 | 12/1973 | Horton | 61/94 |
| 3,789,921 | 2/1974 | DeChassy et al. | 166/0.5 |
| 3,796,273 | 3/1974 | Rininger | 166/0.5 X |
| 3,827,486 | 8/1974 | Hall | 166/0.5 |
| 3,844,345 | 10/1974 | Evans et al. | 166/242 X |
| 3,866,676 | 12/1975 | Burns | 166/72 X |

*Primary Examiner*—Ernest R. Purser
*Assistant Examiner*—Richard E. Favreau
*Attorney, Agent, or Firm*—Poms, Smith, Lande & Glenny

[57] ABSTRACT

An offshore well apparatus so constructed and arranged to minimize chances of pollution of sea water by production fluids which may be released as a result of damage to the well apparatus resulting from natural causes, such as, action of masses of ice at the seabed, earth slides in the seabed formation, and breakage of the production system above the seabed. The offshore well apparatus includes a platform means at the sea surface and a well template means on the seabed formation beneath the platform means, a well casing means supported from the template means and extending into a well hole, riser pipe means extending into the well casing means and having a riser connecting means at its lower end connected to a production fluid control means located at a selected depth within the well casing means, and fluid pressure actuating means for the production fluid control means including means for automatically shutting off production flow at a selected depth below the seabed. The depth location of the production control means is dependent upon the geological characteristics of the seabed formation and is normally located below the action of ice masses on the seabed and below known slippage planes in the geological formation of the seabed. Riser connecting means to the production control means is releasable in the event weather and ocean conditions are severe enough to cause danger to the platform means if the platform is held in normal operating position above the well hole, said riser pipe means having its lower end positioned in the upper portion of the well casing means. An offshore well apparatus including multiple risers for producing a plurality of well holes. A platform structure and well template structure arrange to facilitate a multiple riser system.

33 Claims, 18 Drawing Figures

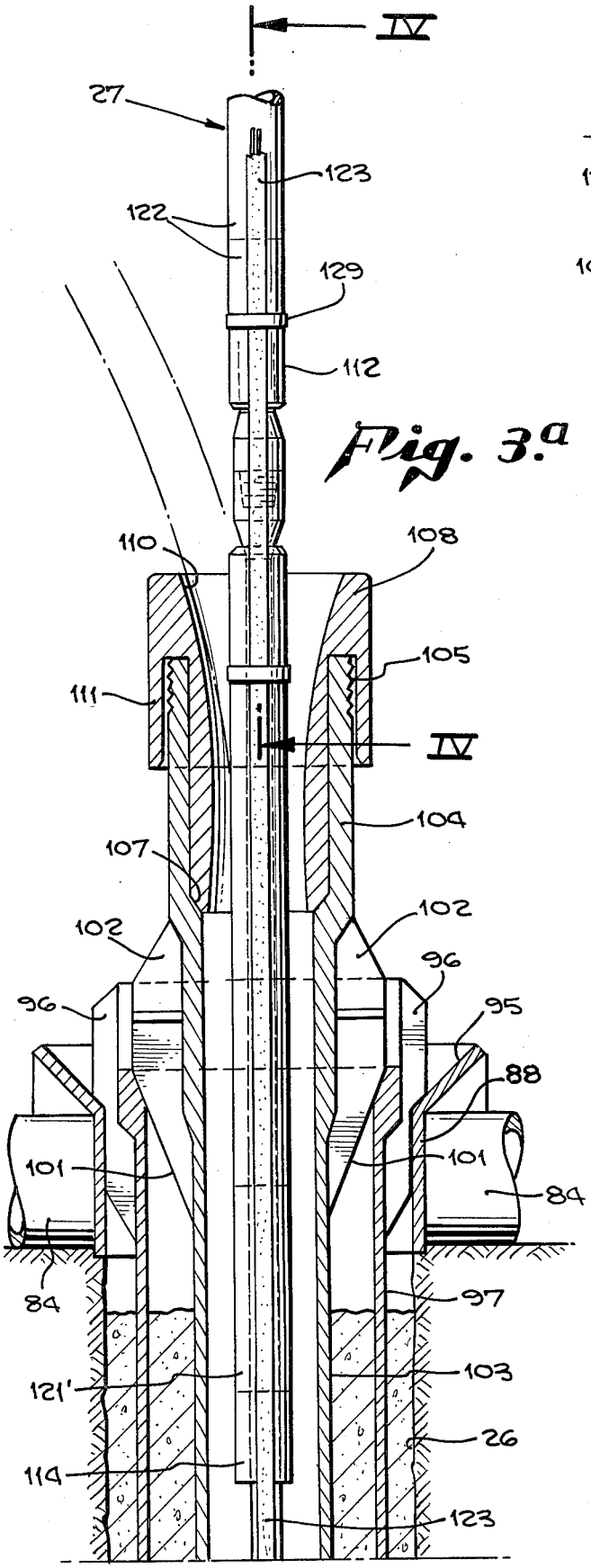
Fig. 3.a
Fig. 3.b
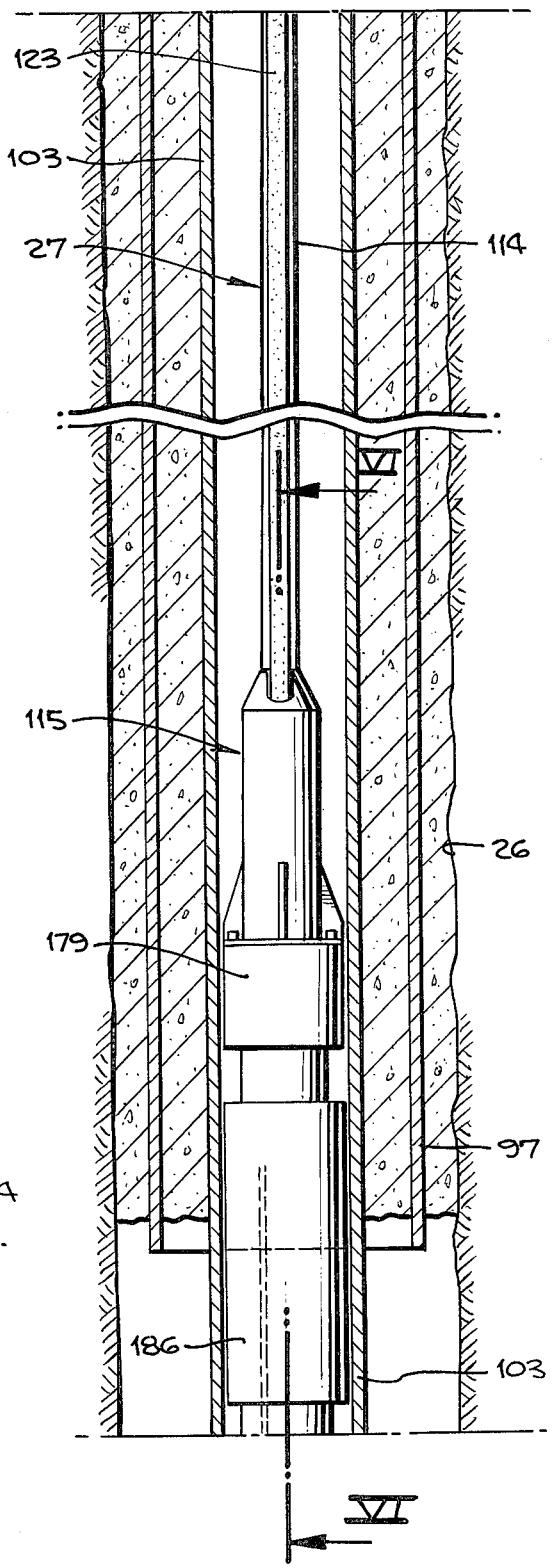

OFFSHORE WELL APPARATUS WITH A PROTECTED PRODUCTION SYSTEM

BACKGROUND OF THE INVENTION

Offshore producing wells are subject to numerous natural hazards. These hazards vary with the geographical location of the well and the geological formation into which the well penetrates. Prior proposed well constructions provided for a very low well head profile on the seabed, the well head being connected to flowlines which conducted the production fluid to suitable storage or other distribution facilities located either on the seabed, on a surface platform means for transfer to a barge, or on shore. In some instances, the well construciton included an enlarged housing which extended into the seabed and provided a chamber for flow control means at a depth below the seabed so as to be unaffected by passage of ice masses or moving objects over and through the surface of the seabed. Such an enlarged housing and chamber will flow control means therein is shown in U.S. Pat. No. 3,866,676.

Other prior proposed completion systems for an offshore well have included placing control valves in a relatively large diameter caisson located below the sea floor. In such systems, a control head extended above the sea floor and the principal control valves were located in the caisson below the floor.

In such prior proposed systems the desire for a low profile well head means at the sea floor was to avoid damage caused by ship anchors, fishing nets, ice masses, or other things which might be dragged along a seabed and which would be likely to strike the exposed well head structures and flow lines.

In recent years, environmental considerations emphasized that ocean waters be freed from pollution by well fluids. In such prior proposed constructions, a mud slide or a shifting of the earth across the line of a well hole might cause breaking of the pipe conducting production fluid to the top of the well. In prior proposed construction including those having flow control means below the surface of the seabed, the flow control means were not located at a sufficient depth below the seabed to cut off leakage of production fluid in the event such a breakage occurred. Moreover, such prior proposed constructions were limited by cost and by the earth mass in the depth that such flow control means could be placed because of the requirement of using caissons of fairly large diameter such as 36 inches or chambers of even greater diameter.

In some prior production installations, a riser pipe extended from the well head at the sea floor to a platform means located thereabove. In severe storm conditions, it may become desirable to release the riser pipe so that damage to the platform structure and well equipment would be minimized. In prior proposed constructions, release of the riser pipe from the well head at the seabed was contemplated. Reconnection of the riser pipe to the well head under these circumstances was time consuming and difficult, particularly in deep water below diver depth.

SUMMARY OF INVENTION

The present invention relates to an offshore well apparatus provided with a construction and arrangement particularly designed for exposure to such hazards as mentioned above and for minimizing spill or leakage of oil from a broken production tubing string, flowline, or riser. The invention particularly relates to a production system for a well wherein production flow will be automatically stopped upon breakage of any of the production lines at a location below the damage part of the well or severed riser system.

The present invention contemplates a production control system for an offshore well which may be embodied in usual well head construction utilizing casing means having an outer diameter in the order of about 16 inches. The invention contemplates a novel riser pipe connector means for connection to a master valve sub means and in the well hole.

Generally speaking, the production control system of the present invention includes a well casing means supported from and extending downwardly from a well template means on the seabed, the casing means extending downwardly for a selected distance below slippage planes in the geological formation of the seabed. At the bottom of the casing means there are provided fail-safe type control valves actuated and held in normally open position by fluid control lines which extend along a riser means and through the casing means to control valves at the selected depth in the seabed. The production system includes a riser connector means located above the control valves, the riser connector means being disengageable from the control valve sub in the event of damage to the flow and control valves above the riser connector means. Disengagement of the riser connector means may occur in the event of severe storm conditions above the surface of the seabed in the event it is undesirable to maintain a connection to the seabed to permit movement of the platform means. In such instances, the lower end of the riser pipe means may move longitudinally in the well casing means below the seabed floor and may hang or dangle loosely in the well connecting means until the severe weather subsides and the riser connector means can be lowered into the well casing means for reconnection with the control valve means. Thus, the loose containment between the lower end of the riser pipe means within the upper end of the casing means providing lateral restraint of the lower end of the riser pipe and facilitates reconnection of the riser pipe means to the flow control means therebelow after the severe weather has ended.

The primary object of the present invention is therefore to provide an offshore well apparatus having a novel production system.

An object of the invention is to provide a novel arrangement of the lower end of a riser pipe means and the upper end of a flow control means located at a selected depth within a well casing means.

Another object of the invention is to provide a novel arrangement of well casing means, riser pipe means and flow control means, which is connected to a production tubing so that production fluid is readily transported to a platform means and distributed, and wherein production flow is stopped in the event damage occurs or is likely to occur to the production system both below the sea surface and above the sea surface.

Another object of the invention is to provide a novel riser connector means for use in a well casing string in a down hole location.

A further object of the present invention is to provide a novel riser pipe means which is connected to down hole equipment and to the platform means in a novel manner.

A further object of the present invention is to provide a novel platform means which includes guide means for the upper ends of a plurality of riser pipe means.

A still further object of the present invention is to provide a platform means for a plurality of riser pipe means and having a novel submerged frame substructure for guiding a plurality of riser means from a plurality of well holes in a seabed.

A still further object of the present invention is to provide a novel platform means and a novel template means, the platform means and template means having corresponding polygonal structure for readily aligning and handling each of a plurality of riser pipe means.

A still further object of the present invention is to provide a well platform means which includes a plurality of hawse pipe means for guiding riser pipe means, the hawse pipe means being positioned in the lower subsea structure of the platform means and having means retaining such hawse pipe means in selected position.

A still further object of the invention is to provide a riser connection and production control means which are operable in a portion of the well hole system operating under well pressure conditions, and wherein large caissons in the vicinity of the seabed to house well head equipment are not required.

The invention contemplates a novel down hole system wherein means are provided at the seabed to reduce a riser bending stresses, a releasable riser connecting means is provided a substantial distance below the seabed surface, production fluid control means are retained in a casing and located below the riser connecting means, and a casing string and tubing string are supported from the casing at a substantial distance below the seabed surface.

The invention further contemplates a riser system for such a down hole arrangement wherein riser end portions extend into hawse pipe at the platform and well casing below the seabed and are provided with abrasive, resistant members to protect the riser end portions as the end portions move relative to the hawse pipe and to the well casing.

Various other advantages of the present invention will be readily apparent from the following description of the drawings which show an exemplary embodiment of the invention.

IN THE DRAWINGS

Figure 1:
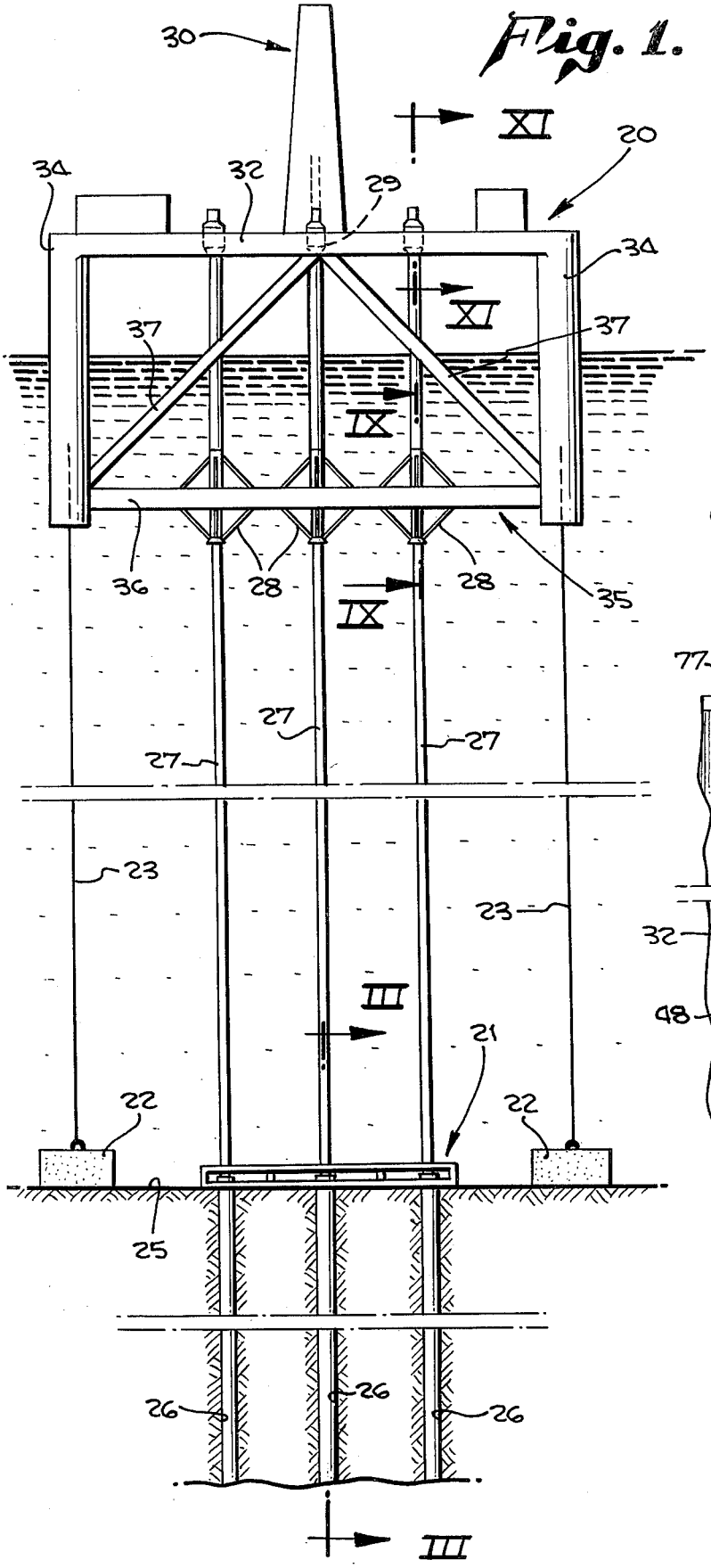
FIG. 1 is a schematic side elevational view of a platform and well production system embodying this invention, the seabed formation being shown in section, and the production control equipment located on the deck of the platform being only schematically illustrated.

FIGS. *3a–d* inclusive are vertical sectional views taken in the vertical plane indicated by line III—III of FIG. 1; FIG. *3a* showing the landing of the protective means of this invention on the template structure at the seabed, FIG. *3b* showing riser connector means located down hole in the protective means, FIG. *3c* showing a sub means for interconnecting the riser connector means with the production flow tubing and including valve means for shutting off production flow, and FIG. *3d* showing the location of a tubing safety valve and production packer at the lowermost end of the protective means.

Figure 4:
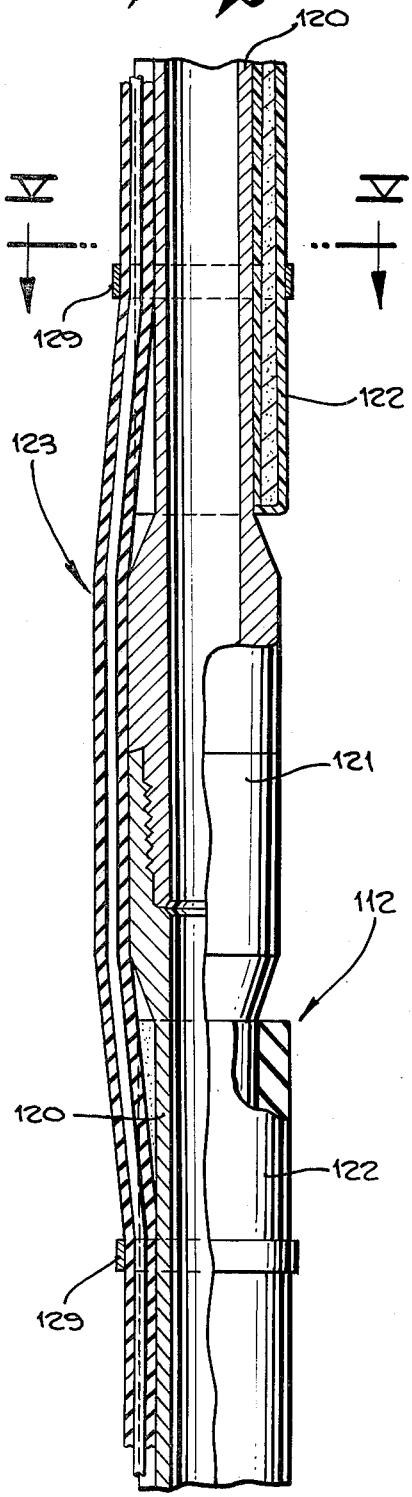

FIG. 4 is a vertical sectional view taken in the plane indicated by line IV—IV of FIG. *3a* and shows typical construction along the riser pipe extending from the template structure to the platform.

Figure 5:
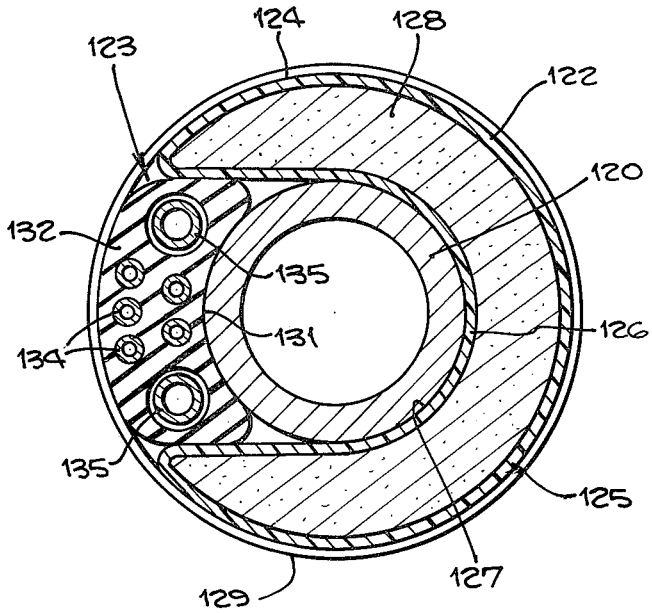

FIG. 5 is a transverse sectional view of the riser pipe means taken in the plane indicated by line V—V of FIG. 4.

FIGS. *6a* and *6b* are enlarged fragmentary sectional views taken in the vertical plane indicated by line VI—VI of FIG. *3b*, FIG. *6a* showing the lower grief joint which connects the riser pipe means to the riser connector, and FIG. *6b* showing partly-in-section the riser connector joint and the upper part of the sub means.

Figure 7:
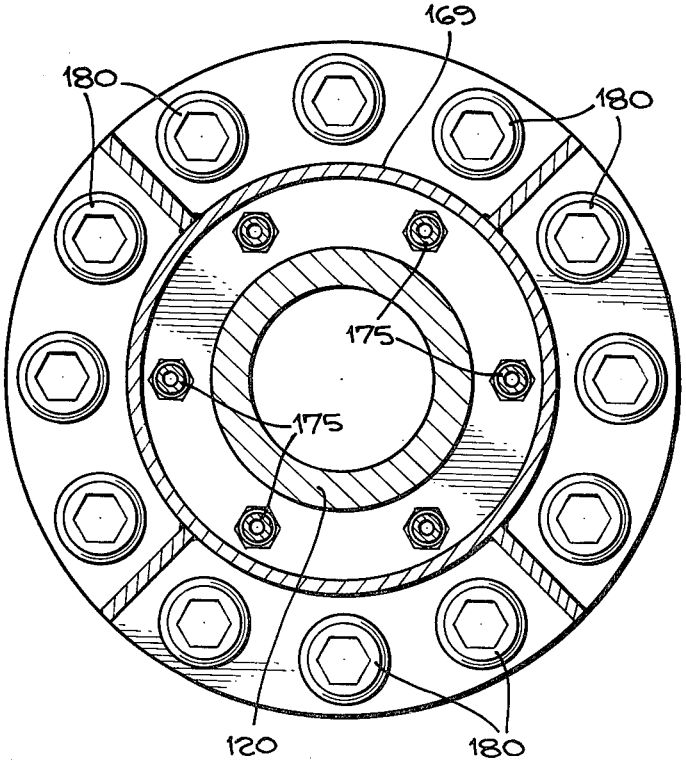

FIG. 7 is an enlarged transverse sectional view taken in the plane indicated by line VII—VII of FIG. *6a*.

Figure 8:
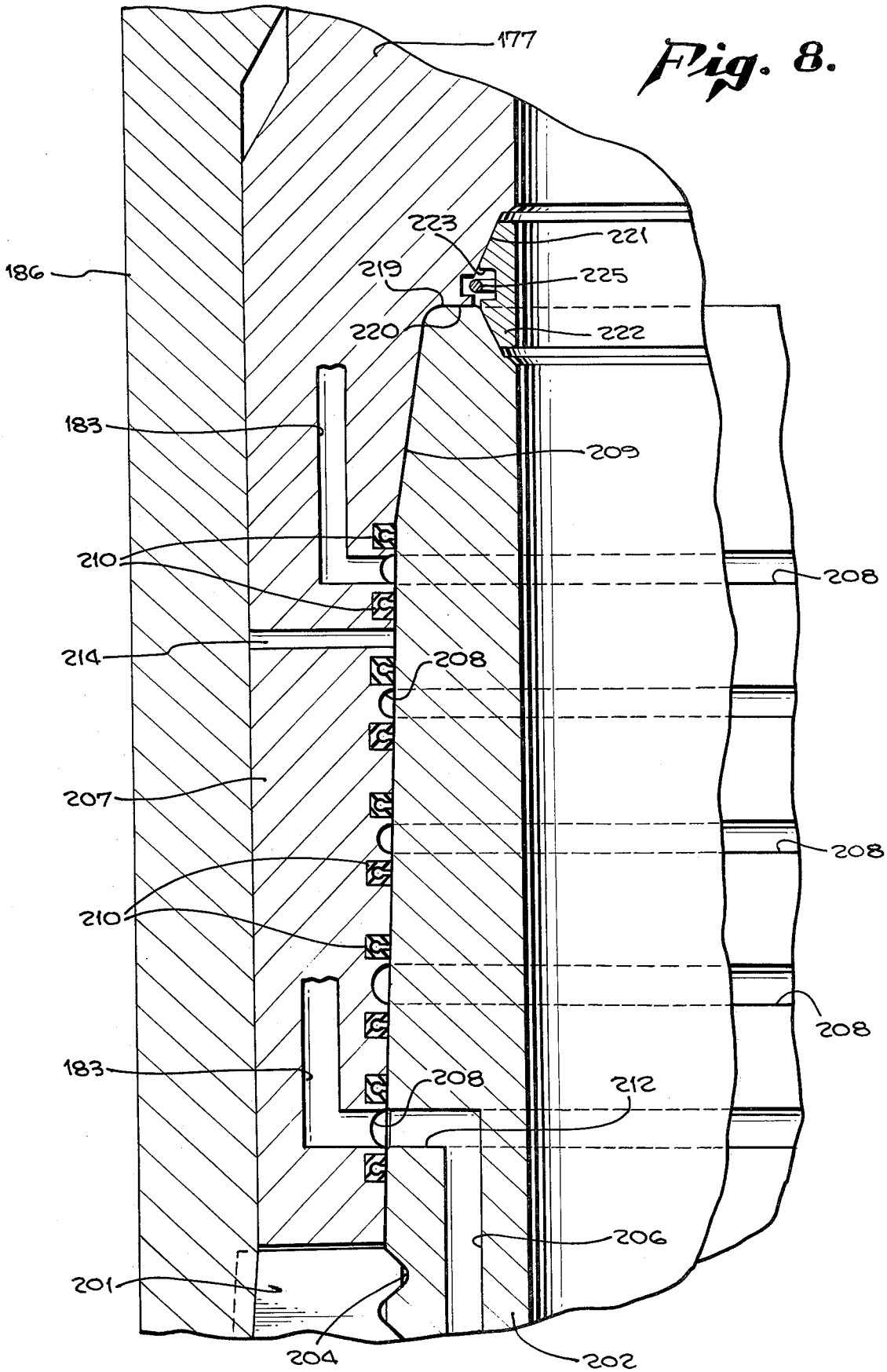

FIG. 8 is an enlarged fragmentary sectional view of the riser connector and the upper part of the sub means.

Figure 9:
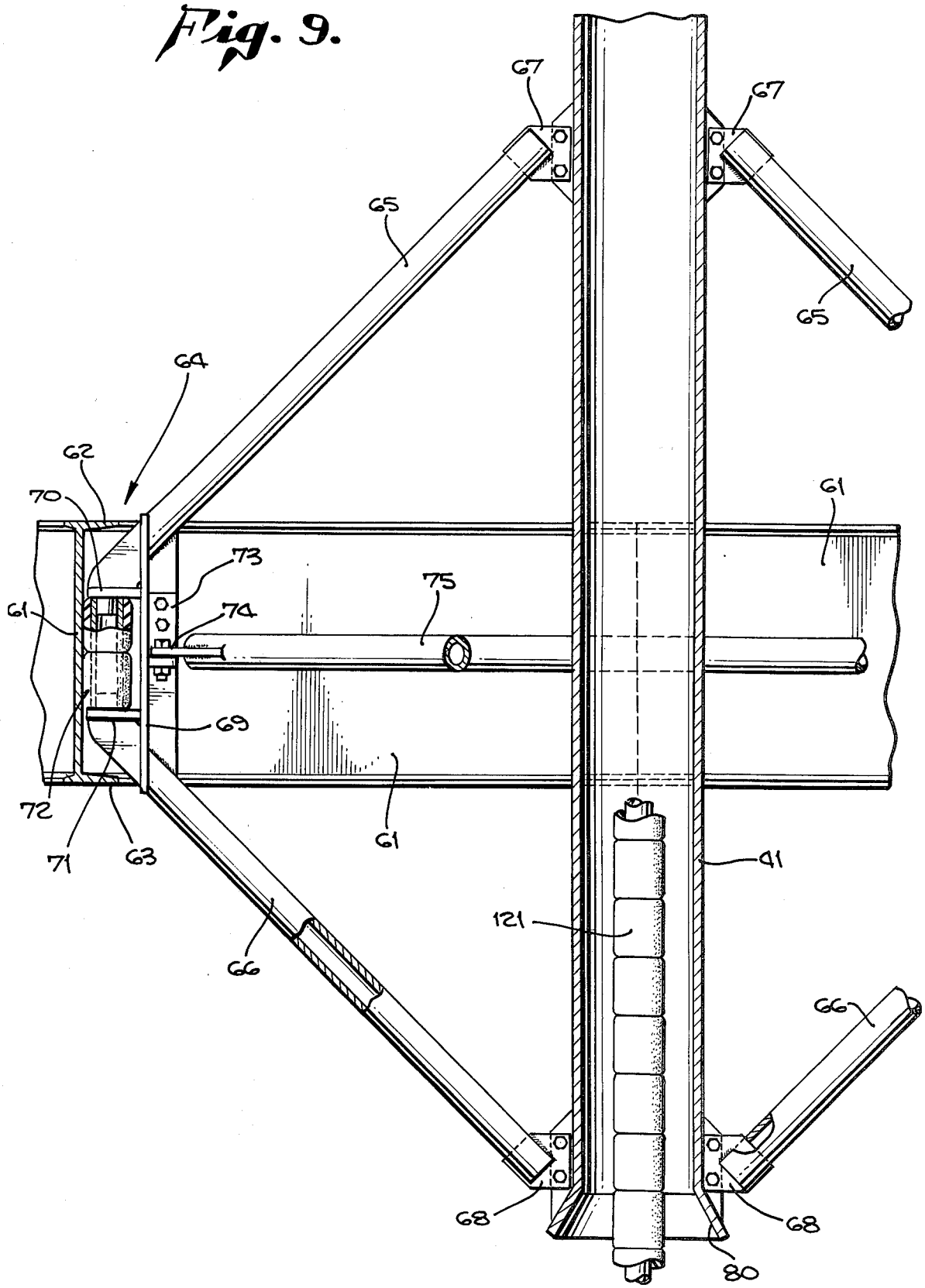

FIG. 9 is an enlarged fragmentary vertical sectional view taken in the plane indicated by line IX—IX of FIG. 1 and showing the lower hawse pipe support structure.

Figure 10:
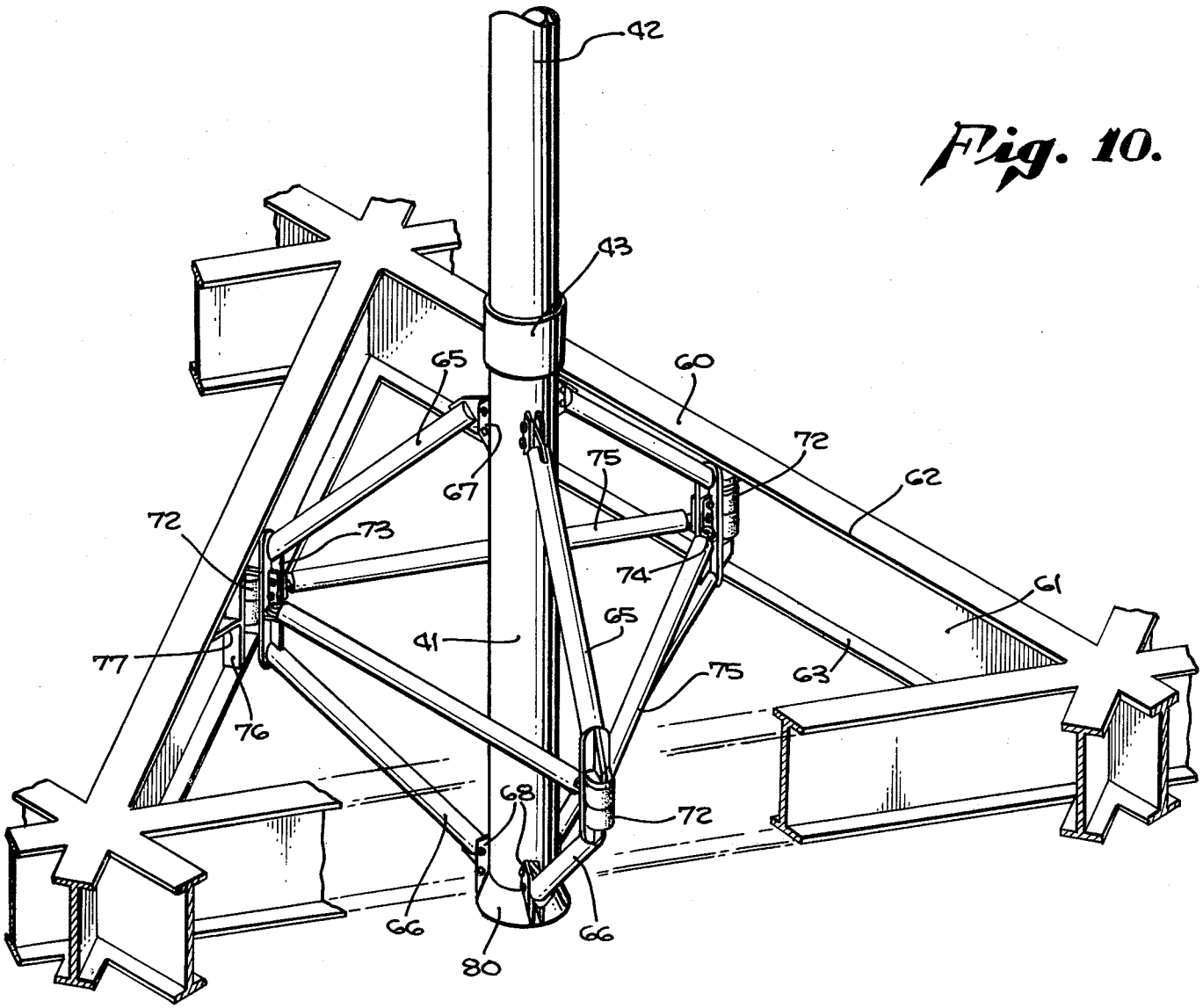

FIG. 10 is a perspective view of the lower hawse pipe support structure, a part of one of the structural beams being broken away for clarity.

Figure 11:
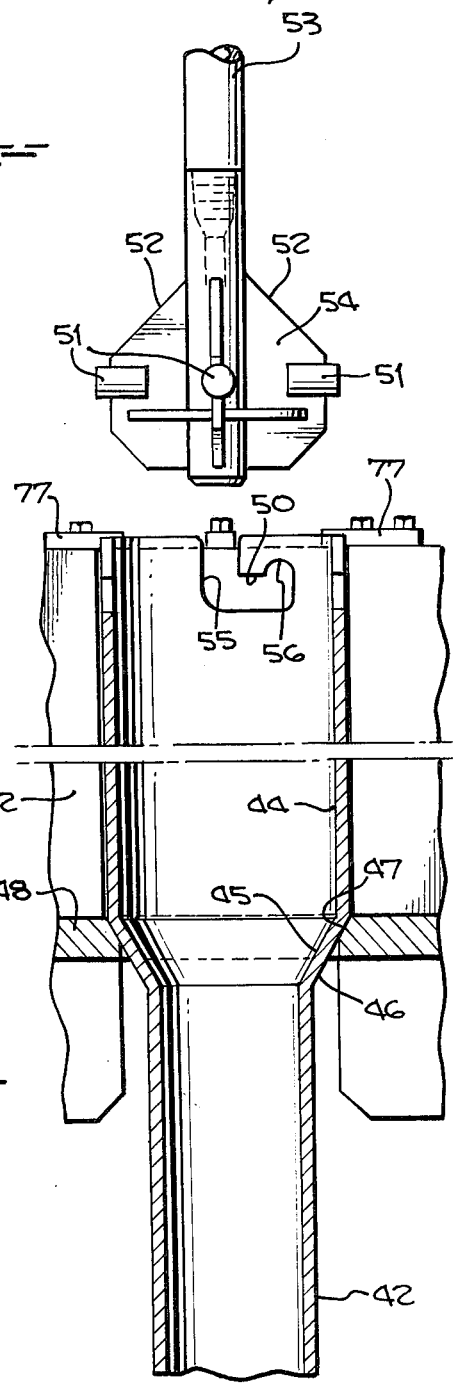
Figure 2:
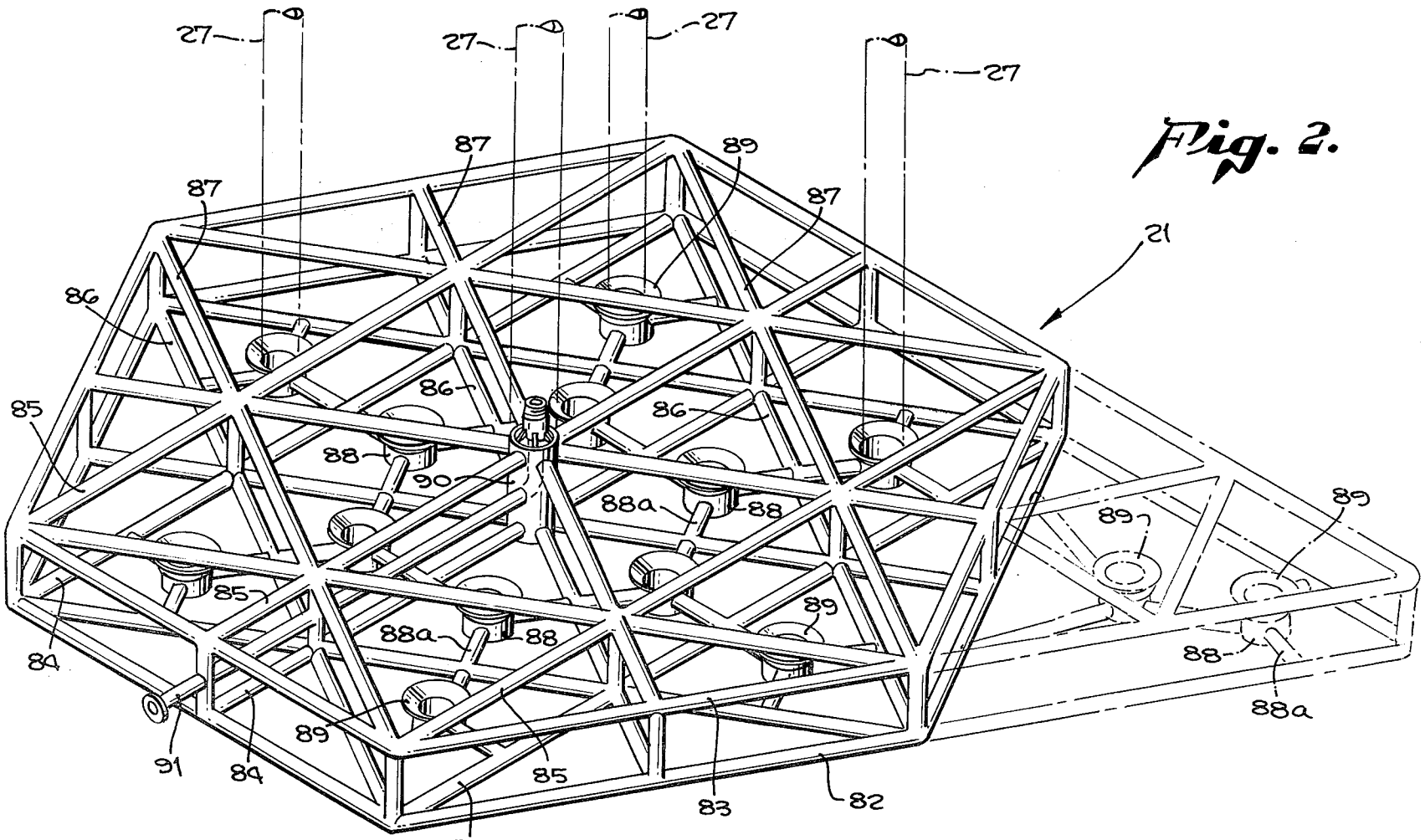
FIG. 2 is a perspective view of a seabed template structure which may be used with the apparatus of this invention.

FIG. 11 is an enlarged fragmentary sectional view taken in the vertical plane indicated by line XI—XI of FIG. 1 showing upper hawse pipe structure at the platform deck and a hawse pipe landing tool.

Figure 12:
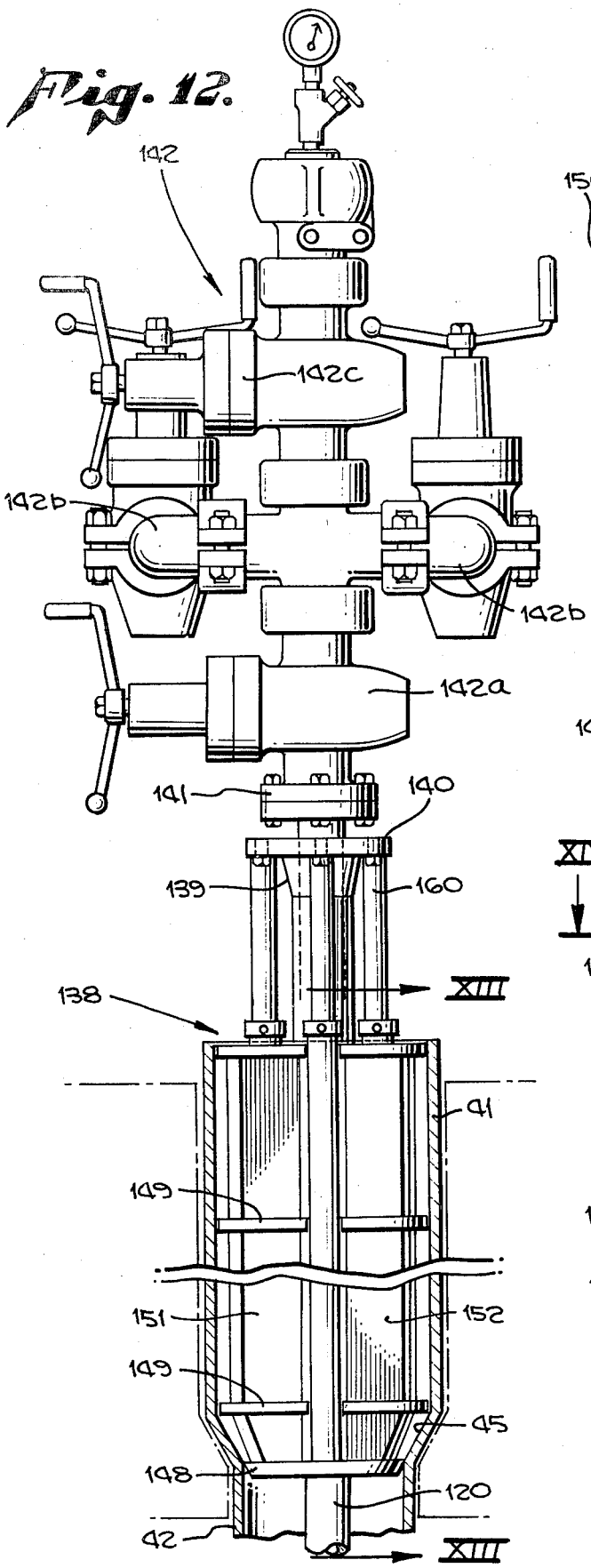

FIG. 12 is a fragmentary sectional view showing the upper hawse pipe structure with riser tensioning means mounted therein and with production control equipment connected to the top end of the riser means.

Figure 13:
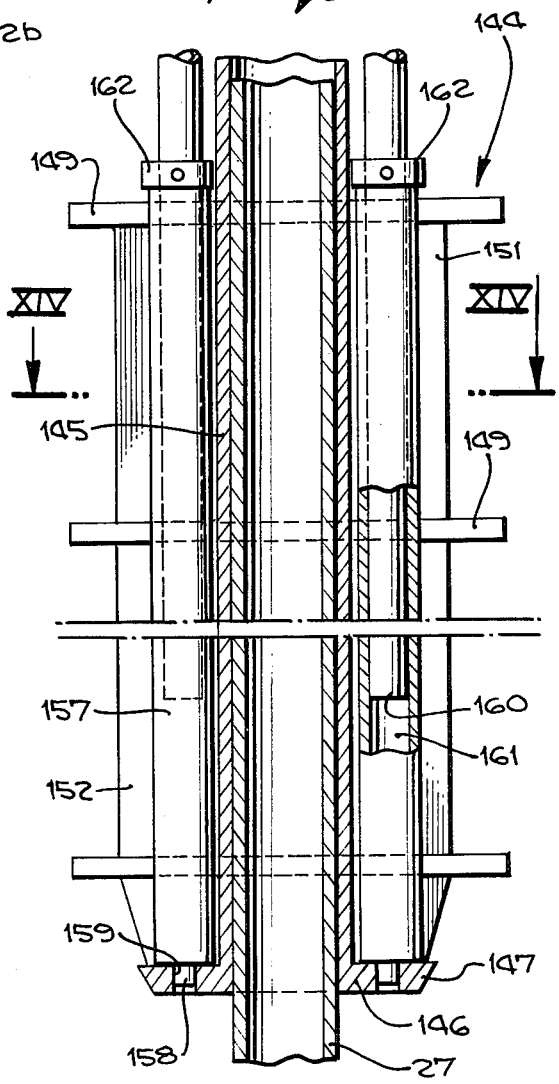

FIG. 13 is a transverse sectional view taken in the plane indicated by line XIII—XIII of FIG. 12.

Figure 14:
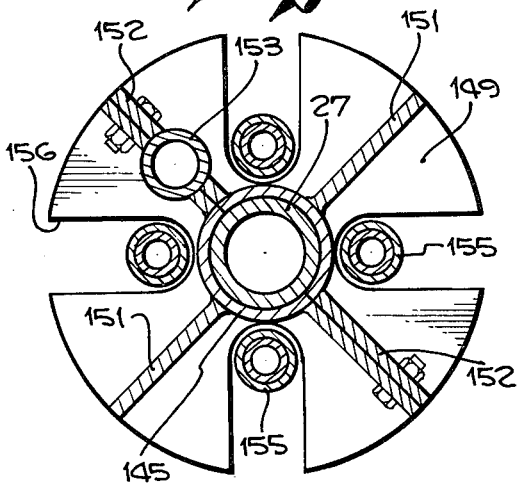

FIG. 14 is a transverse sectional view taken in the plane indicated by line XIV—XIV of FIG. 13.

An offshore well production system embodying the present invention is schematically shown in FIG. 1. A floatable platform means generally indicated at 20 may be positioned over a well template structure generally indicated at 21 and retained in such position by suitable anchor means 22 connected through anchor or mooring lines 23 to the platform means 20. The template structure 21 is located on a seabed formation 25 and over one or more well holes generally indicated at 26. Extending upwardly from the template structure 21 may be one or more riser means 27 which are guided through lower hawse means 28 and upper hawse means 29 to production control equipment schematically indicated at 30 on the platform means. The down hole production system and construction is not shown in FIG. 1, but is illustrated in FIGS. *3a–d* inclusive and will be described in detail later.

Floatable platform means 20 may be of suitable design; a preferred design is that of a tension leg platform as described and claimed in U.S. Pat. No. 3,780,685. Such a platform means includes a top production deck 32 supported above surface 33 of the ocean by a plurality of buoyant vertical columns 34 interconnected by a submerged lower platform structure 35 which may include horizontal buoyant members 36 and diagonal buoyant members 37 extending between the deck 32 and the lower portion of vertical columns 34. The displacement ratio between the horizontal buoyant members 36 and the total buoyancy of the platform means may be between 0.30 and 0.60, as described in said patent. The anchor lines 23 may be generally vertically disposed or splayed slightly outwardly or inwardly. The anchor lines 23 or tension legs are placed under selected tension by controlling the buoyancy of the submerged horizontal members 36 and the submerged portions of vertical columns 34 so that deck loads and other varying loading conditions on the platform means will not cause tension legs 23 to become slack. The tension leg platform constructed as described in said Letters Patent provides cancellation of vertical forces acting on the tension legs and minimizes motions of heave, roll and pitch of the platform. It will be understood that various types of platforms, including tension leg platforms, semisubmersible platforms equipped with suitable riser tensioning systems, and fixed leg platforms may be utilized with features of the present invention and it is not intended that the present invention be limited to use with a tension leg platform, although such use is preferable.

Riser Guide Structure

Guide structure of the platform means 20 for the riser means 27 is illustrated in FIGS. 9, 10, 11, 12 and 13. The exemplary guide structure includes an upper hawse portion 40 at deck 32, a lower hawse portion 41 at lower platform structure 35, and an intermediate hawse portion 42 extending therebetween and connected to the lower hawse portion 41 extending therebetween and connected to the lower hawse portion 41 by a suitable coupling sleeve 43. Upper hawse portion 40 includes an enlarged cylindrical top end 44 provided with a reduced section 45 having an outer conical surface 46 which provides a landing face for seating of the hawse portion 40 on the correspondingly conical landing surface 47 provided on structural member 48 of platform deck 32. Top hawse end 44 may be provided J-hook slots 50 in 90° spaced relationship which may be engaged by pins 51, also arranged in 90° relationship on a bottom end 52 of the landing tool 53. Each pin 51 is secured to a suitable gusset plate 54 and is readily engaged with the J-slots 50 by lowering the landing tool 53 through vertical section 55 of slots 50 and then turning tool 53 until pins 51 are in position for engagement with a return recess 56 at the upper end of the lateral portion of the J-slot 50. When the hawse means is installed by lowering through opening 58 provided in deck 32, upper hawse portion 40 will be landed upon landing surfaces 47 of deck member 48. The landing tool is readily released by lowering the tool for a short distance to disengage pins 51 from recesses 56 and then turning the tool until the pins are aligned with the vertical sections 55 of the J-slots whereby the tool may be withdrawn upwardly and disengaged from the upper hawse portion 40.

The hawse means extends downwardly for the height of the platform to the lower structure 35, which may include a plurality of structural steel members 60 of H or I section arranged to provide a plurality of triangular framed openings in which webs 61 and top and bottom flanges 62 and 63 of the steel sections provide a three sided channel guide for cooperation with positioning means generally indicated at 64 for aligning lower hawse portion 41 with the center of a triangular framed opening. Positioning means 64 includes a plurality of sets of top and bottom diagonal members 65 and 66. The top ends of members 65 are fixed to lower hawse portion 41 in suitable manner as at 67 by welding and bolting. In similar manner, the lower ends of support members 66 are fixed to the lower end of hawse portion 41 as at 68. The converging end portions of sets of members 65, 66 may be welded to a vertically disposed plate 69 having laterally extending vertically spaced lugs 70, 71, which provide support for ends of a suitable roller means 72. The cylindrical surfaces of roller means 72 engage inner surfaces of web 61. Plate 69 is provided with an inwardly directed flange 73 normal to plate 69. Adjacent ends of horizontal support members 75 may be attached thereto as at 74.

At a selected location along web 61 of each of the structural members 60 forming a triangular framed opening may be welded a vertically disposed stop plate 76 extending between flanges 62, 63. A reinforcing gusset 77 is welded to plate 76 and to web 61. The opposite face of plate 76 provides a stop surface for roller means 72 to precisely position and hold lower hawse portion 41 centrally of the framed triangular opening.

When the hawse pipe is landed on landing surfaces 47, it is readily positioned by rotation thereof with landing tool 53. When roller means 72 are stopped in abutment with plates 76, the upper hawse portion 40 may be secured against rotation by lock bars **77*a* engaged in recesses formed at the top section of hawse section 40, the lock bars 77*a* being secured to the deck structure 32**.

The hawse pipe means at the platform means provides a position and alignment means for riser pipe means 27 which extends through the hawse pipe means. The lower end of the hawse pipe means may be provided with an outwardly flared bottom end 80 for facilitating positioning of and cooperation with riser pipe means 27.

Subsea Template Means Between the platform means and resting upon the seabed formation is well template structure 21. The template structure 21 may be of any suitable construction and in this example is in the form of a hexagon with vertically spaced parallel side template members 82, 83 interconnected by a plurality of internal template members 84, 85 so arranged as to provide a plurality of triangular bottom openings 86 and corresponding top openings 87 positioned in correlation with the triangular framed openings in the lower platform structure 35. Within triangular bottom openings 86 members 84 and angularly spaced structural members **88*a* support and position a plurality of conductors 88, each coaxially aligned with a hawse pipe means carried by the platform means. An outwardly flared upper flange 89 on each conductor 88** facilitates reception therethrough of subsequently installed conductor pipe elements.

At the center of the hexagonal template structure 21, a vertically disposed hollow cylindrical hub 90 may be connected to a production flowline 91 through which production fluid may be transmitted along the ocean surface to a suitable storage tank or to other suitable installation for handling production flow. The upper end of member 90 includes a provision for attachment of a production transfer riser which may be remotely connected for production flow and also utilized together with other equipment, not shown, to assist in lowering the template 21 to the seabed formation. Each of conductors 88 in template structure 21 is arranged to receive, land and guide a well casing means for riser pipe means 27 through the template structure. For example, a primary conductor or casing may be landed and cemented through the conductor 88. This primary casing is supported during cementing operations by fins or gussets 96 bearing upon flange 89. Additional casings may be landed sequentially and cemented in place.

Riser Protective Means

Means for protecting riser pipe means 27 in its subsea bed extension in well hole 26 is best seen in FIG. *3a–d* inclusive. In FIG. *3a*, conductor 88 is shown positioned over well hole 26 and has an upwardly outwardly flared flange 89 providing a landing surface 95 in cooperation with radially extending landing fins 96 provided on the top end of an elongated outer casing member 97. Outer casing member 97 extends downwardly into the well hole a selected distance depending upon the seabed formation and geological structure thereof; for example, about 100 feet. Casing member 97 is provided with a conical landing surface 100 which is engaged by a correspondingly tapered edge 101 of landing fins 102 of a subsurface housing or casing member 103. Casing member 103 includes a relatively thick metal section adjacent landing fin 102 and, above the said thick section, has an enlarged end 104 provided with provision for remote connection at 105 to a blowout preventer connector (not shown). Within end 104 of the inner casing member may be provided an internal landing surface 107 which served to land and hold an unsecured riser shoe 108 which has a downwardly facing internal shoulder 109 seated on the top edge of the top end 104 of the casing 103 and has a tapered landing surface at 107 as previously described. The internal configuration of the riser shoe 108 is provided with a longitudinally extending convex surface 110 about which riser means 27 may bend without extreme localization of stresses in riser means 27 when the platform means is laterally displaced from its normal position above the template. A cylindrical outer skirt 111 on shoe 108 serves to protect mandrel configuration 105 against damage.

Inner casing member 103 may extend downwardly into the well hole beyond the end of outer casing member 97 a selected distance, dependent upon the geological formation of the seabed and geological area; for example, presence of ice masses, sufficient to cover and protect production control valves in the well hole and control lines leading to production equipment located further down in the well hole.

Riser Pipe Means

Generally speaking, the riser pipe means 27 may comprise an upper riser portion 112 extending from below the template 21 to above the platform deck and a lower portion 114 which extends from below the template 21 to approximately the end of outer casing 97 in the well hole at a depth of about 100 feet. At this depth, riser pipe means 27 is connected by a riser connector 115 to production fluid control means generally indicated at 116 and thence to a production tubing string 117, which extends to the oil bearing zone of the well.

Upper riser portion 112 is best seen in FIGS. *3a*, 4, 5, 7 and 12–14. Upper riser portion 112 includes riser pipe sections 120 interconnected by suitable double seal tool joints, one of which is shown at 121, FIG. 4. Riser sections 120, extending between the platform means and template, may be enclosed by a generally U-shaped buoyant cowl or jacket 122 and a longitudinally extending control line bundle means 123 which occupies the space between the ends of the legs of jacket 122. Each jacket 122 may be of any suitable length and includes an outer wall 124 of suitable material such as fiberglass, which defines a part cylindrical surface 125. Outer wall 124 includes an internal wall portion 126 having a semi-cylindrical surface 127 to snugly fit the outer cylindrical surface of riser pipe section 120. Within wall 124 of the jacket 122 is provided a suitable buoyant material 128 such as a plastic syntactic foam or the like.

Each of the buoyant jackets 122 is secured around riser pipe section 120 by suitable retaining bands or clamps 129.

Control line bundle means 123 includes an elongated resilient flexible strip of suitable rubber-like material formed into an arcuate section having an inner circumference 131 corresponding to the outer circumference of riser pipe section 120 and an outer part cylindrical surface 132 formed on the same radius as outer surface 125 of buoyant cowl 122. The width of the control bundle means 123 may be approximately the distance between the ends of the legs of the U-section jacket 122 so that the control bundle means may fit snugly into the space between said legs. Retaining band 129 secures the control bundle means along the length of the riser pipe section 122.

As best seen in FIG. 4, control bundle means 123 is adapted to flex in a radially outwardly direction to longitudinally pass over the enlarged cylindrical portions of tool joints 121 between riser pipe sections 120.

Control line bundle means 123 is preferably formed with a plurality of control lines embedded therein and bonded thereto so that the control bundle means 123 may be readily handled as by coiling on a reel and uncoiling therefrom for feeding onto the riser pipe means. In this example, five fluid control lines 134 are shown in spaced relation within the central portion of the cross section of the control line bundle means. At opposite ends of the section of the control bundle means as annulus line 135 is shown. Such control lines in the control bundle are used in usual manner as hereinafter described.

The buoyant riser pipe jackets 122 provide selected buoyancy so that the length of riser pipe extending between the template 21 and lower hawse portion 41 will serve to partially buoyantly support the riser pipe to the well. The buoyancy forces are determined by the weight of the entire riser pipe means including the weight of production fluid which flows upwardly through the riser pipe means to the production equipment on the platform deck. The buoyant jackets may be omitted from that portion of the riser pipe which extends through the hawse means on the platform to the platform production deck, it being noted that the control bundle means 123 will extend upwardly along the riser pipe through the hawse means to the production deck.

As shown in FIG. 9, the upper portion of the riser pipe which extends into the platform hawse means may carry a plurality of abrasive, resistant rubber like cylinders 130', which protect the upper portion of the riser pipe during relative movement between the riser pipe and the hawse pipe 41. An example of relative dimensions may include a riser pipe of 4½ to 5 inches OD, cylindrical members 130' 8 inches OD, and the hawse pipe of 16 or 18 inches OD. The members 121 may be in relatively short length segments and while they serve to stiffen the upper portion of the riser pipe, bending of the riser pipe within the hawse pipe is permitted in order to spread or dissipate bending stresses imposed upon the riser pipe by permitting some bending of the riser pipe within the hawse pipe. The lower riser pipe portion, which extends into the casing 103, may be similarly equipped with abrasion resistant rubber like cylindrical members 130' for the same purpose as above described.

Riser Tensioning Means

The uppermost riser pipe section 120 is shown in FIG. 12 and FIG. 13 as extending through the upper hawse portion 41. Enlarged upper hawse portion 41 serves to receive a riser tension means generally indicated at 138. The upper end of the uppermost riser pipe section 120 may be slightly outwardly flared at 139 to merge with and provide strength for integral annular flange 140 connected to the upper end of riser tensioning means 138. The upper end of riser pipe section 120 also includes a flanged connection 141 to a production manifold head 142 which is supported on top of the riser pipe section and riser tensioning means.

Production manifold head 142 includes a main control valve 142*a*, a pair of flowline control valves 142*b*, each provided with a swivel ball joint connection to the end of the flowline to accommodate relative movement therebetween caused by motion of the riser pipe means. The entire production manifold head 142 moves as a unit relative to the production deck.

Riser tensioning means 138 includes an enlongated spider means 144 comprising a central cylindrical casing 145 provided at its bottom end with a radially outwardly extending seating flange 146 having conical edge surfaces 147 for seating as at 148 on the tapered inner surfaces 45 of the upper enlarged hawse portion 41. At longitudinally spaced intervals along the length of the casing 145 are provided transverse spider members 149 having circular edges adapted to fit within the internal cylindrical surfaces of hawse walls 44. Extending radially outwardly from casing 145 at 90° spaced intervals are vertically extending ribs 151 to support spider members 149. Dual vertical ribs 152 may be provided along one of the diameters and one of said dual ribs 152 may be provided with a vertical cylindrical passageway means 153 for passing therethrough the upper end of control line bundle means 123.

Riser tensioning means 138 includes four piston and cylinder means 155, each located in aligned radial slots 156 in spider members 149. The lower end of each cylinder 157 may be seated on bottom flange 146 and positioned by an axial stub 158 which extends into a hole 159 provided in flange 146. Within each cylinder 157 is a piston 160 defining with the cylinder a chamber 161 for pressure fluid. The upper ends of piston rods 160 project above the top of hawse means 41 and are connected to annular flange 140 of the riser pipe section. Suitable sealing collars 162 are provided above the top spider member 149. Pressure fluid lines extending to fluid chambers 161 are not shown, such pressure fluid lines being in communication with a pressure fluid source and accumulator which may be controlled by well-known means for varying pressure in cylinder chambers 161 to compensate for any up and down movements of the platform deck with respect to the riser means so that undue stresses will not be placed on the riser pipe or upon the platform structure.

Riser pipe means 27 extends downwardly from the platform deck through the hawse means, is buoyantly supported in the water between the platform means and the template means and enters the inner casing 103 to extend downwardly below the template for a selected distance. Thus, riser pipe means 27 is not fixedly connected to the template means but passes through the template means with a sliding unfixed flexible connection to the well casing means.

Figure 6A:
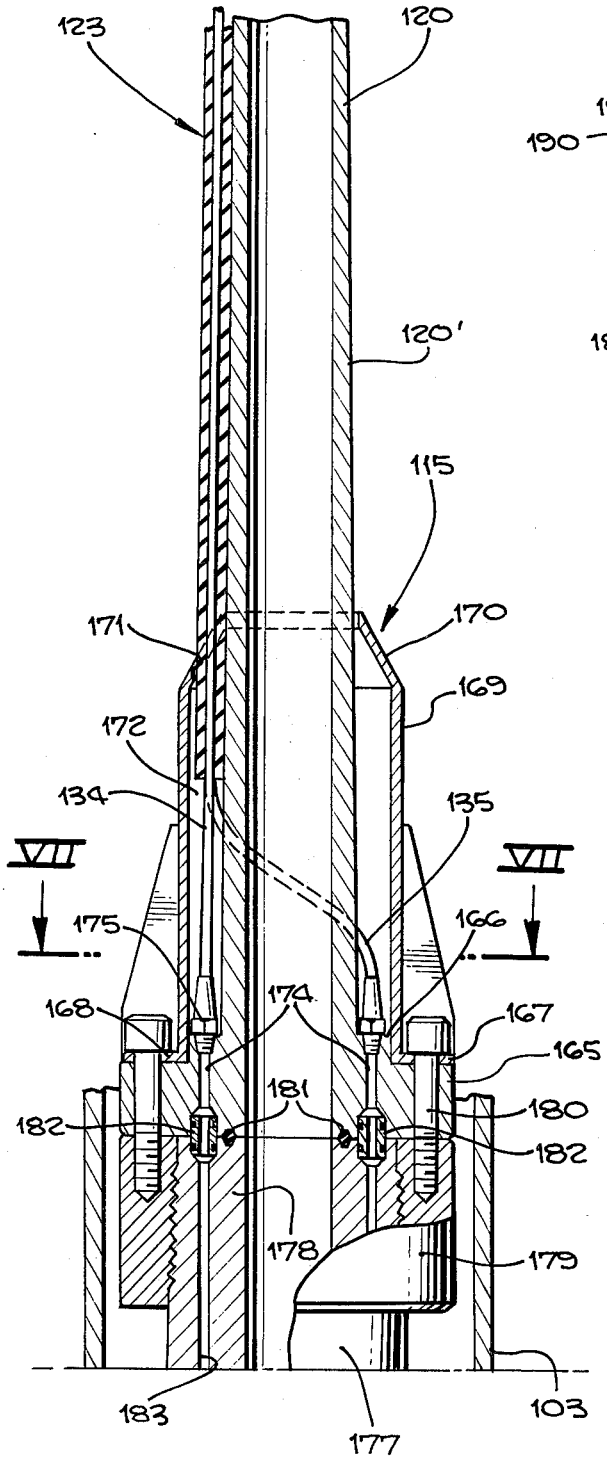
Figure 6B:
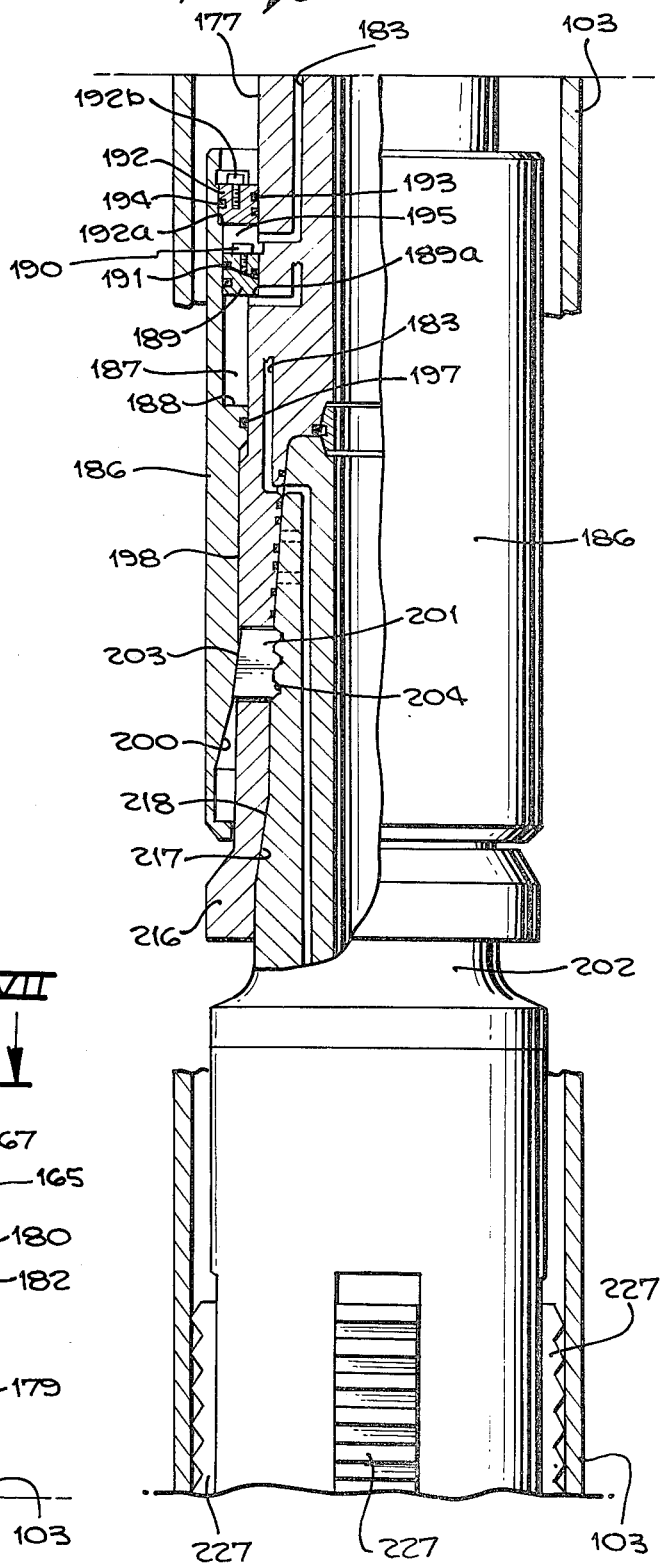

Lower riser portion 123 extends downwardly through the inner casing 103 to a selected depth, in this example about 100 feet, for connection to riser pipe connector means 115 shown in detail in FIGS. 6*a*, 6*b* and FIG. 8.

Riser Connector Means

Riser connector means 115 is shown in FIGS. 3*b*, 6*a*, 6*b* and FIG. 8. In FIG. 6*a*, lowermost pipe section 120 includes a riser grief joint comprising pipe section 120' having a tapered wall section increasing in thickness towards its lower end. At the lower end of pipe section 120' a relatively thick section radial flange 165 is provided with an annular stepped shoulder 166 having an outer radius less than the outer radius of flange 165. The stepped shoulder 166 defines an annular seat 167 for flanged end 168 of a cylindrical protective housing 169 which extends along pipe section 120° and which has a top end 170 converging to the cylindrical surface of pipe section 120' and provided with a notched opening 171 for permitting control line bundle means 123 to pass into said protective housing. Protective housing 169 provides an annular space 172 for distribution of bundle control lines including annulus lines 135 and hydraulic fluid control lines 134 in circularly spaced relation around the flanged base of the pipe section 120'. Each control line 134, 135 may be connected to passageways 174 in flange 165 by connecting fittings 175.

The riser connector means 115 also includes a connector body 177 having an upper end 178 externally threaded for engagement with a collar 179 to which flanged base 165 of pipe section 120' may be secured by circumferentially spaced screw bolts 180. The interface of the upper end face of collar 179 and upper end 178 of body 177 and the opposed end face of the flange 165 on the pipe section 120' is provided with suitable annular inner seal 181 for sealing against production fluid.

Passageways 174 in flange 165 are aligned with passageways 183 in body 177 and are in fluid communication through metal tubes 182 which extend across the interface joint line. O-ring seals are provided on the metal tubes on opposite sides of the joint line for sealing against loss of hydraulic control fluid. Metal tubes 182 not only provide communication between the aligned passageways in flange 165 and in body 177, but also prevent unthreading or uncoupling of collar 179 after the screw bolts connect flange 165 to collar 179. Without the metal tubes 182, body 177 could turn relative to collar 179. The use of tubes 182, which extend into flange 165 and body 177, prevents relative rotation between flange 165 and body 177 and through bolts 180 prevent unthreading of collar 179. Thus, unexpected separation of the joint because of vibration or stresses tending the move the two parts of the joint relative to each other is prevented.

Riser connector means 115 also includes an external barrel 186 having an upper portion, defining with body 177, an annular fluid locking chamber 187 defined at its lower end by an internal shoulder 188 formed on barrel 186 and at its upper end by a ring member 189 fixed to body 177 between lock ring and bolt means 190 and shoulder 189*a*. Ring member 189 is provided with suitable seal rings 191 against body 177 and seal rings 192 against walls of the barrel 186. The upper open end of barrel 186 is provided with a ring member 192 secured on the barrel between shoulder 192*a* and lock ring and bolt means 192*b*. Ring member 192 is sealed against body 177 as at 193 and against the upper end of the barrel as at 194 for defining with the ring member 189 an unlocking chamber 195 having communication with one of the fluid control passagways 183 as shown in FIG. 6*b*.

Below internal annular shoulder 188 on the barrel, a seal 197 is provided for slidable sealing engagement with the cylindrical surface of body 177 within locking chamber 187. Below shoulder 188 the internal surface of barrel 186 is provided with sliding engagement as at 198 with the cylindrical surface of body 177. The internal surface of barrel 186 is provided an outwardly downwardly flaring internal surface 200 at the lower end of the barrel 186 for wedging cooperation with a plurality of circumferentially spaced locking dogs 201 carried on riser body 177 for locking engagement with the upper end of a mandrel 202.

As best seen in FIG. 6*b*, introduction of pressure fluid into locking chamber 187 through the control fluid line 183 connected thereto will cause the barrel to move downwardly to urge the wedging surfaces 200 against the outer wedge surface 203 of locking dogs 201 to cause the dogs to move inwardly into interlocked engagement as at 204 with mandrel 202. Introduction of pressure fluid by one of the control lines 183 into the unlocking chamber 195 will cause the barrel 186 to move upwardly to relieve the wedging pressure of the barrel against the locking dogs 201 so that the locking dogs may be free to retract radially outwardly and thereby permit the riser connector body 177 to be disengaged from the mandrel 202.

The riser connector means 115 includes, in the riser connector body 177, a plurality of fluid passageways 183, each of which are provided fluid communication with respective passageways 206 in mandrel 202. In FIG. 6, each passageway 183 terminates at the lower cylindrical portion 207 of the body in an annular groove 208 provided in the internal surface 209 of the lower body portion 207. Above and below each annular groove 208 in body portion 207 are provided seal ring means 210 to prevent loss of control fluid when mandrel 202 and riser body 177 are interconnected in mating relation. Each passageway 206 is provided with an opening 212 spaced longitudinally along the axis of mandrel 202 for longitudinal registration with respective annular groove 208 for the corresponding control passageway 183 provided in body 177. When mandrel 202 is fully longitudinally mated with body 177, pressure fluid control lines of the control line bundle means are in communication with respective passageways through body 177 and mandrel 202.

Seal means 210 above and below each connection of passageways 183 and 206 serve to localize any leakage of control fluid at such connection. In the event leakage should occur, a vent passageway 214 is provided in mandrel 202 between each lower seal means 210 of an upper passageway connection and each upper seal means of the lower passageway connection so that loss of fluid pressure in one of the control lines can be readily identified. Further, control fluid of different control lines will not be intermixed which might cause malfunction or misfunction of the fluid control system. Thus, in the event one of the fluid control lines leaks through a seal at the interconnection of riser body 177 and mandrel 202, loss of pressure in the leaking line readily identifies the control line.

The riser connector means 115 also includes means for positively limiting relative longitudinal movement of the riser connector body 177 with respect to the mandrel 202 during mating. In FIG. 6*b* the lower end of skirt 216 of riser body 177 includes an internal conical surface 217 which is adapted to land upon a corresponding conical landing surface 218 provided on mandrel 202. The landing surfaces 217 and 218 serve to axially align body 177 and mandrel 202. When riser body 177 has been moved downwardly relative to mandrel 202, upper end face 219 of mandrel 202 moves into abutment with an internal annular shoulder 220 provided on body 177. A positive stop is provided by abutment faces 219 and 220 of the mandrel and body respectively to assure that the passageways 183 and 206 are positioned in registration for fluid communication therebetween by means of the annular grooves 208 in body 177.

Opposite the abutment interface of the mandrel 202 with the shoulder 220 on body 177, an internal generally V section groove 221 is provided by internal surfaces of the mandrel and of the body to receive an annular triangular section metal ring 222 having tapered external surfaces corresponding to surfaces on body 177 and mandrel 202. Ring 222 has a circumferential recess 223 opposed to an internal recess 224 provided on body 177 and within which is positioned a polygonal securement snap wire 225. Wire 225 is circumferentially radially inwardly collapsible to assemble ring 222 on the body 177 and expands radially outwardly into recess 224 to retain ring 222 in body 177. The sealing faces of ring 222 and of the body 177 and mandrel provide metal-to-metal contact which is under pressure from the production fluid in the riser pipe means.

Production Fluid Control Means

Fluid control means 116 includes a master valve sub 226 positioned in inner casing 103 below riser connector means 115 by retrievable packer means including circumferentially arranged locking slips 227 below which may be provided suitable annular packing means 228. The master valve sub 226 includes passageways 206' communicating with corresponding riser connector passageways and annulus passageway 229 communicating with the corresponding passageway in the riser connector, and a central through bore 230 providing communication with the center bore in riser pipe means 27. Valve sub 226 carries a pair of longitudinally spaced fail-safe valves 232 in the production flow of central bore 230. Fail-safe valves 232 may be of well-known type and are normally held in open position by fluid control pressure. In the event fluid pressure fails, valves 232 automatically close by mechanical means so that upward production flow will be stopped and contained therebelow.

A similar fail-safe type valve 233 is provided in annulus line 229 and is operated in a manner similar to that for valves 232.

The lower end of the master valve sub 226 may be suitably connected to a connector sub 235 provided with a passageway 206'' having suitable metal tubular fittings at 236 to the passageway 206' of the valve sub. Annulus passageway 229 of the valve sub communicates with a passageway 229' in the upper part of connector sub 235 and annular space 237 surrounding connector sub 235. The connector sub 235 may be connected to the upper end of tubing hanger 239 by a plurality of circumferentially spaced locking dogs 240, as in the riser connector means 115. Fluid communication between the passageways 206' and 206''' in the tubing hanger may be accomplished in a manner similar to that described between the riser connector body and the mandrel (FIG. 6*b*).

Tubing hanger 239 is positioned in the sub surface housing 103 by circumferentially spaced retractable dogs 241. Annulus passageway 229'' is provided with a fail-safe valve 242, similar to fail-safe valves 232 and 233. The tubing hanger 239 carries a packing 243 for sealing against the inner surfaces of casing 103. Tubing hanger 239 provides a threaded connection at 244 for the upper end of tubing string 117, the tubing hanger and the upper end surfaces of casing hanger 245 being provided with complementary landing surfaces as at 246 to support the tubing string 117.

Casing hanger 245 may have inclined surfaces at the bottom of the casing hanger for landing at a reduced section of the casing 103 as at 247. Packing means 248 is provided between the outer cylindrical surfaces of the casing hanger 245 and the internal surfaces of casing 103. A casing string 249 may be threadedly connected at 250 to casing hanger 245, casing 249 extending downwardly over tubing string 117 and within casing 103 until casing 103 ends, in the example, at about 3,000 feet below the seabed.

Figure 3C:
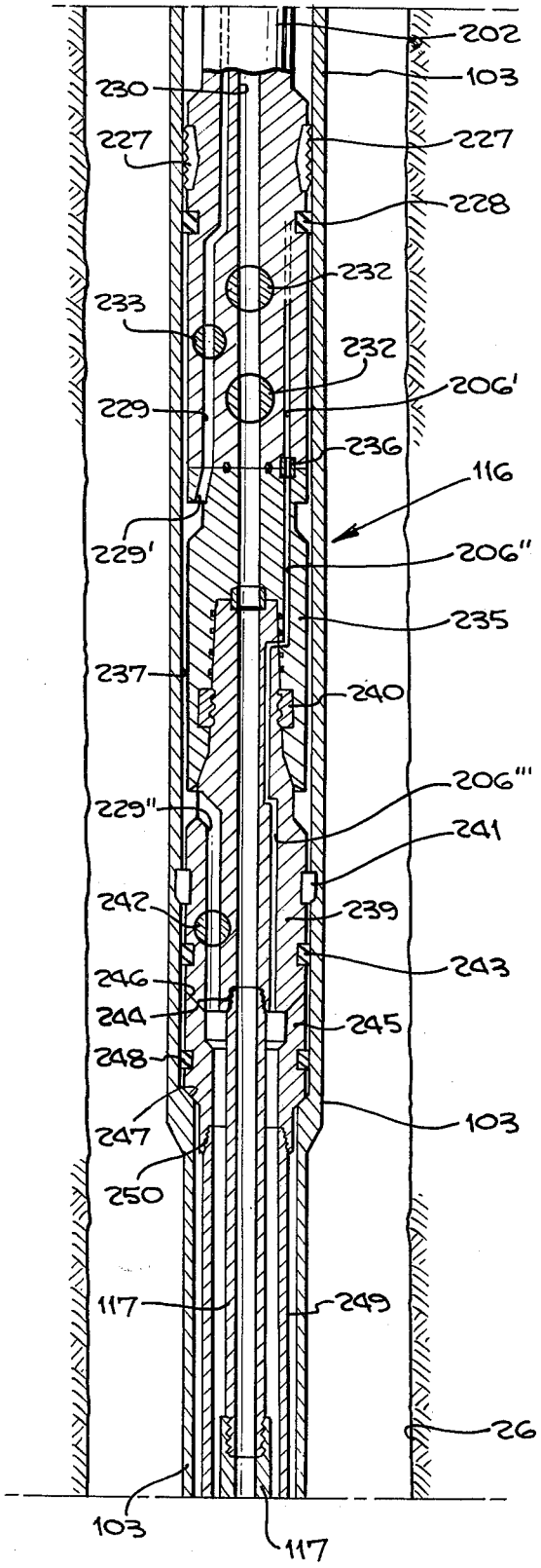
Figure 3D:
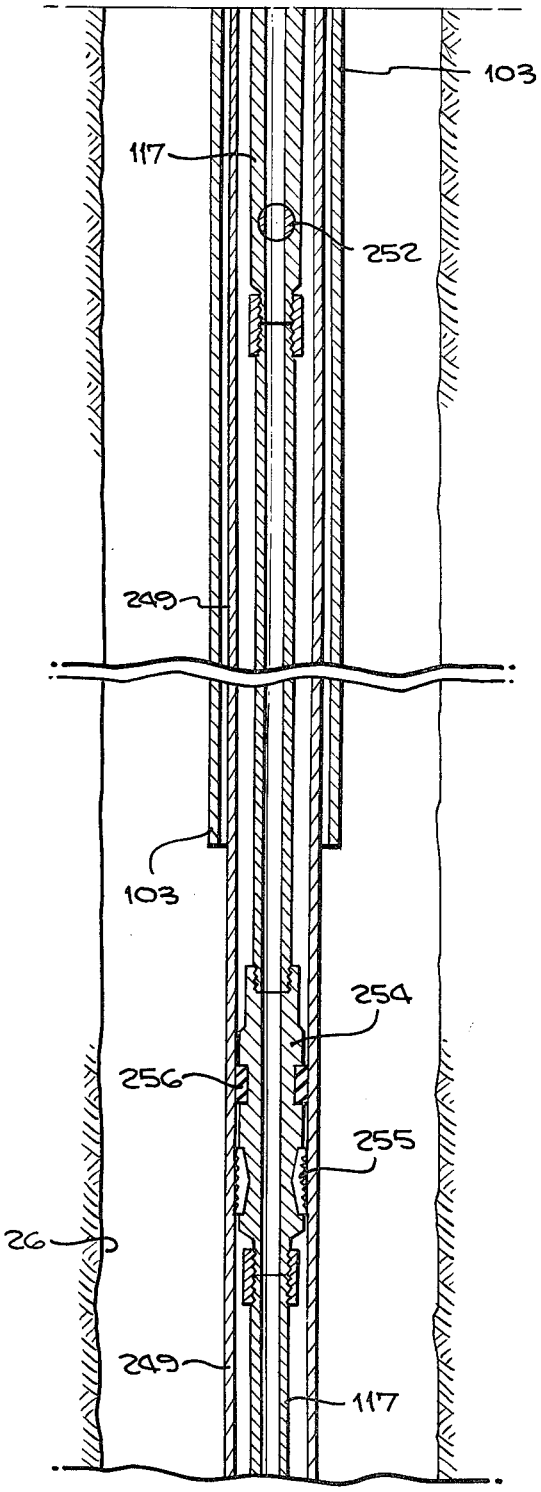

As best seen in FIG. 3*d*, tubing string 117 is provided with a fail-safe valve 252 which may be of ball-type because of space limitations. Valve 232 may be a gate-type valve. Both valves 252 and 232 may be fail-safe type valves; that is, upon failure of fluid pressure the valves close using a mechanical spring means. Valve 252 is located in the central passageway or bore of the production flow tubing string 117 and serves to close or shut off the flow of production fluid in the event the fluid control line should fail.

Tubing string 117 extends downwardly below the subsurface casing 103 and is encased with casing string 249. At a selected depth, a retrievable production packer 254 carries circumferentially arranged locking slips 255 for engagement with casing 249 to hold the production packer 254 at a selected position in the casing 249. An annular packing 256 is carried by the production packer 254 for sealing engagement with the casing string 249. The tubing string 117 extends downwardly into the producing zone of the well.

Fluid Actuating Means

Fluid pressure actuating means 260 for the production control means may comprise a suitable source of fluid pressure carried on the platform means 20 in usual manner. Actuating pressure fluid is conducted from the platform deck through the control line bundle means 123 as described above. As shown in FIG. 6*a* at the lower riser grief joint 120' the control lines 134 and the annulus lines 135 depart from the bundle means 123 and are distributed circularly about the axis of the joint for connection respectively to the passageways 174 in the flange or base 165 and thence to the passageways 183 in the upper end of the riser connector body 177. The riser connector body as shown in FIGS. 6*b* and 8, provides a connection to the corresponding passageways 206 in the upper end of mandrel 202.

The actuating pressure fluid lines are conducted through the mandrel 202 into the master valve sub 226 and then connected to a respective valves 232, 233, 242 and 252 to maintain said valves in normal open position during production operation. As described above, such valves are held in open position by the actuating fluid pressure. In the event of reduction of fluid pressure beyond a selected pressure or complete loss of pressure the valves are mechanically operated to closed position and thereby seal off the production flow first at the depth at which valve 252 is located and then at the depth at which valve 232 are located.

Production flow may be shut off under control of an operator at the platform deck by control valves in the actuating pressure fluid lines at the deck. In the event a land mass slide should cause the riser pipe means and the control line bundle means running along side thereof to break or be damaged to cause leakage of production fluid into the seabed formation and into the ocean waters, the fail-safe valves 252 and 232 would be automatically actuated to closed position upon drop in pressure of the actuating fluid. In the event the control line bundle remained intact but the riser pipe means was damaged the operator at the platform deck could drop the pressure in the actuating fluid to move the valves to closed position.

In the event the platform was subjected to severe storm conditions including heavy waves, high winds, and strong ocean currents so that the riser pipe means might be subjected to severe stress, the riser connector means 115 is releaseable from the mandrel of the master valve sub 116 by introducing pressure fluid into the unlocking chamber 195 of the riser connector means to cause the barrel to move upwardly relative to the connector body 177 and to thereby release the locking dogs 201. Since the riser connector means is located at a selected depth beneath the seabed such as about 100 feet as shown in FIG. 3*b*, the riser pipe means 27 will hang from the hawse pipe means on the platform means and will be free to move upwardly and downwardly in the inner and outer casing means in the upper portion of the well hole. Bending of the riser pipe means at the riser shoe 108 will be along a radius curve such as 110 and concentrated bending stresses are not imposed on the riser pipe means 27 at the well template. The amount of lateral movement of the platform means with respect to the template means is dependent upon a number of factors depending upon the method of securing the platform means, the strength of the wind and the waves, and the behavior of the platform under such severe weather conditions. In the event the platform means remains tethered to its anchor means during such severe weather conditions the lateral offsetting of the platform means with respect to the well template means is limited and during such lateral movement the lower end of the rise pipe means 27 may remain hanging within the well casing means. When severe weather ends and the platform means is relocated in proper position above the well template means, the riser pipe means 27 which still has its lower end within the casing means of the well may be lowered for reconnection of the riser connector means with the control sub 116. Upon such reconnection of the riser connector means the actuating pressure fluid lines are brought into corresponding registration for conducting actuating pressure fluid to the fail-safe valve means which may then be actuated to open position by the actuating fluid pressure and the production operation resumed.

It is important to note in that part of the off-shore well apparatus of this invention which lies between seabed and the sea surface, the well template means 21 and the subsurface structure 35 of the platform means are in vertically aligned orientation and are adapted to accommodate a plurality of riser means 27 extending from the conductor members 89 on the well template to the hawse means carried by the platform means and having a lower hawse portion centered in a triangular opening in the submerged structure 35. In the present example, the riser pipe means is shown at the platform means and at the well template without a fixed connection. In this example, the riser pipe means extends upwardly through the hawse pipe means in sliding telescopic relation and also downwardly into the well casing means in sliding telescopic relation for connection to the riser connector means and control valve sub means. Another form of connection of riser pipe means to such a platform means and well head template means is described and claimed in a co-pending application Ser. No. 831,379 on riser pipe means with non-fixed connections.

It is also important to note that bending stresses on the riser pipe are subject to reduction by the curved internal surfaces on the riser shoe at the seabed, by the outwardly flared surfaces at the bottom of the hawse pipe on the platform, by permitting the riser end portions to extend into the platform hawse pipe and the well casing means for a substantial distance whereby some restraint on bending will occur in the hawse and casing pipe by flexing of the riser pipe end portions therein, and by the use of riser pipe segments having tapered wall sections of selected length and thickness depending upon the installation. In this example, the tapered riser pipe section is shown as extending from the riser connector means in the well casing. Such tapered riser pipe section may also be used at the location of the riser shoe at the well template and in inverted position at the bottom of the hawse pipe on the platform. It is important to note that at the connection of the riser pipe to the riser connecting means within the well casing, that such connection is subject to minimal bending stresses as compared to bending stresses imposed upon a riser connection made at a well head at the sea floor.

It will be understood that various modifications and changes may be made in the offshore apparatus described above which come in the spirit of this invention and all such changes and modifications coming within the scope of the appended claim are embraced thereby.

I claim:

1. In a production control system for offshore well apparatus including a platform means and a well template means on a seabed formation beneath the platform means, the combination of:

well casing means supported from said template means and extending into a well hole in the seabed formation for a selected depth;

a riser pipe means extending downwardly from said platform means through said well template means into said well casing means to a selected depth within the depth of the well casing means;

a production fluid control means in said well casing means;

fluid pressure actuating means on said platform for said production fluid control means;

control line means interconnecting said fluid pressure actuating means and said production fluid control means;

a tubing string in fluid communication with said production control means and with said riser pipe means through said production control means;

a riser connecting means between the lower end of said riser pipe means and above the upper end of said control means, and interconnecting said control line means with said production control means, said riser connecting means being releasable from said production control means to free the lower end of said riser pipe means from its connection to said production control means;

and means at said production control means for automatically shutting off production flow at said selected depth of the production control means upon loss of fluid pressure in said actuating means between said platform means and said production control means.

2. In a system as stated in claim 1 including means at said well template means having a convex surface for accommodating bending of said riser pipe means upon lateral movement of said platform means relative to said template means.

3. In a system as stated in claim 1 wherein the lower end of said riser pipe means is relatively contained within the upper portion of said well casing means upon disengagement of said riser connecting means with said production control means.

4. In a system as stated in claim 1 wherein said well casing means includes an outer conductor casing landed on said well template means;

an inner casing landed on said outer casing at said template means and extending below said outer casing;

said production fluid control means being located in said inner casing.

5. In a production control system for offshore well apparatus including a platform means and a well template means on a seabed formation beneath the platform means, the combination of:

well casing means supported from said template means and extending into a well hole in the seabed formation for a selected depth;

a riser pipe means extending downwardly from said platform means into said well casing means to a selected depth within the depth of the well casing means;

a production fluid control means in said well casing means;

fluid pressure actuating means for said production fluid control means;

a tubing string in fluid communication with said control means and with said riser pipe means through said control means;

and a riser connecting means between the lower end of said riser pipe means and the upper end of said control means, said riser connecting means being releasable from said control means to free the lower end of said riser pipe means from its connection to said control means;

said actuating means having means for automatically shutting off production flow at said selected depth of the control means upon loss of fluid pressure in said actuating means between said platform means and said production control means;

said well casing means including an outer conductor casing landed on said well template means;

an inner casing landed on said outer casing at said template means and extending below said outer casing;

said production fluid control means being located in said inner casing;

said inner casing including an upper portion having a wall of thick section;

said production fluid control means being located in said thick section wall portion of said inner casing.

6. In a production control system for offshore well apparatus including a platform means and a well template means on a seabed formation beneath the platform means, the combination of:

well casing means supported from said template means and extending into a well hole in the seabed formation for a selected depth;

a riser pipe means extending downwardly from said platform means into said well casing means to a selected depth within the depth of the well casing means;

a production fluid control means in said well casing means;

fluid pressure actuating means for said production fluid control means;

a tubing string in fluid communication with said control means and with said riser pipe means through said control means;

and a riser connecting means between the lower end of said riser pipe means and the upper end of said control means, said riser connecting means being releasable from said control means to free the lower end of said riser pipe means from its connection to said control means;

said actuating means having means for automatically shutting off production flow at said selected depth of the control means upon loss of fluid pressure in said actuating means between said platform means and said production control means;

the lower portion of said riser pipe means which extends into said well casing including a plurality of collar means for contact with said upper portion of said inner casing.

7. In a production control system for offshore well apparatus including a platform means and a well template means on a seabed formation beneath the platform means, the combination of:

well casing means supported from said template means and extending into a well hole in the seabed formation for a selected depth;

a riser pipe means extending downwardly from said platform means into said well casing means to a selected depth within the depth of the well casing means;

a production fluid control means in said well casing means;

fluid pressure actuating means for said production fluid control means;

a tubing string in fluid communication with said control means and with said riser pipe means through said control means;

and a riser connecting means between the lower end of said riser pipe means and the upper end of said control means, said riser connecting means being releasable from said control means to free the lower end of said riser pipe means from its connection to said control means;

said actuating means having means for automatically shutting off production flow at said selected depth of the control means upon loss of fluid pressure in said actuating means between said platform means and said production control means;

said riser pipe means including a plurality of buoyant cowl members fixed to said riser pipe means extending above said well template means affording buoyant support for said riser pipe means.

8. In a system as stated in claim 7 wherein said buoyant cowl members are of generally U-section and define a longitudinally extending space;

control line bundle means extending longitudinally in said space;

and means securing said bundle means and said cowl members to said riser pipe means.

9. In a system as stated in claim 8 wherein said control line bundle means is of arcuate section and includes fluid control lines embedded in spaced relation in resilient material.

10. In a production control system for offshore well apparatus including a platform means and a well template means on a seabed formation beneath the platform means, the combination of:

well casing means supported from said template means and extending into a well hole in the seabed formation for a selected depth;

a riser pipe means extending downwardly from said platform means into said well casing means to a selected depth within the depth of the well casing means;

a production fluid control means in said well casing means;

fluid pressure actuating means for said production fluid control means;

a tubing string in fluid communication with said control means and with said riser pipe means through said control means;

and a riser connecting means between the lower end of said riser pipe means and the upper end of said control means, said riser connecting means being releasable from said control means to free the lower end of said riser pipe means from its connection to said control means;

said actuating means having means for automatically shutting off production flow at said selected depth of the control means upon loss of fluid pressure in said actuating means between said platform means and said production control means;

and hawse pipe means on said platform means receiving the upper end portion of said riser pipe means.

11. In a system as stated in claim 10 wherein said hawse pipe mens is provided with an enlarged upper end portion landed on said platform means;

said riser tensioning means being landed in said enlarged upper end portion of said hawse means.

12. In a system as stated in claim 10 including a platform deck on said platform means;

said hawse pipe means extending to said platform deck;

said riser pipe means projecting above said platform deck from the upper end of said hawse pipe means;

and riser tensioning means connected to the upper end of said riser pipe means.

13. In a system as stated in claim 12 including production head means supported on top of said riser pipe means above said riser tensioning means.

14. In a production control system for offshore well apparatus including a platform means and a well template means on a seabed formation beneath the platform means, the combination of:

well casing means supported from said template means and extending into a well hole in the seabed formation for a selected depth;

a riser pipe means extending downwardly from said platform means into said well casing means to a selected depth within the depth of the well casing means;

a production fluid control means in said well casing means;

fluid pressure actuating means for said production fluid control means;

a tubing string in fluid communication with said control means and with said riser pipe means through said control means;

and a riser connecting means between the lower end of said riser pipe means and the upper end of said control means, said riser connecting means being releasable from said control means to free the lower end of said riser pipe means from its connection to said control means;

said actuating means having means for automatically shutting off production flow at said selected depth of the control means upon loss of fluid pressure in said actuating means between said platform means and said production control means;

said platform means including a platform deck and a submerged structure;

a hawse means for said riser pipe means interconnecting and extending between said platform deck and the submerged structure;

and means for positioning the lower end of the hawse means in the submerged structure of the platform means.

15. In a system as stated in claim 14 wherein said well template means including internal frame members forming polygonal openings corresponding to the polygonal openings in said platform submerged structure;

and conductor members supported centrally of the well template frame members whereby said hawse pipe means is positionable in substantially vertical alignment with said conductor members.

16. In a system as stated in claim 14, including a plurality of hawse pipe means carried by said platform means;

and a plurality of conductor members carried by said well template means and positioned to correspond with said hawse pipe means on said platform means.

17. In a system as stated in claim 14 wherein said positioning means for the hawse means includes frame members defining polygonal openings in the submerged structure;

and guide rollers carried by said hawse means and extending laterally therefrom in corresponding polygonal arrangement for engagement with said submerged structure frame members.

18. In a system as stated in claim 17 including stop means for said guide roller means on said submerged structure frame members;

and means securing said hawse pipe means against rotation.

19. In an offshore well apparatus comprising in combination:

a platform means;

a well template means on a seabed formation;

well casing means extending from said well template means into a well hole;

riser pipe means extending from said platform means through said template means and downwardly into said well casing means;

fluid control means in said well casing means at a selected depth therein and adapted to be connected to a production tubing string;

riser connector means interconnecting the lower end of said riser pipe means and said fluid control means in said well casing and at a selected depth below said template means and below hazardous zones in said seabed formation;

and fail-safe valves at said fluid control means for automatically closing upon failure of fluid pressure above said fluid control means.

20. In an offshore well apparatus comprising in combination:

a platform means;

a well template means on a seabed formation;

well casing means extending from said well template means into a well hole;

riser pipe means extending from said platform means through said template means and downwardly into said well casing means;

fluid control means in said well casing means at a selected depth therein and adapted to be connected to a production tubing string;

and riser connector means interconnecting the lower end of said riser pipe means and said fluid control means in said well casing and at a selected depth below said template means and below hazardous zones in said seabed formation;

riser pipe means including a bundle of control lines;

said riser connector means including passageway means for communicating said control lines of said bundle to fluid control means in said well casing;

and means for releasably locking said riser connector means to said fluid control means.

21. In an offshore apparatus including a floating platform means having means adapted to be connected to the upper end of a riser means, the combination of:

well means below said platform means;

said well means having a well casing extending into a seabed formation;

riser pipe means extending from said platform means into said well casing and adapted to be releasably connected to well equipment located down hole of said well casing;

said riser pipe means extending into said well casing a distance sufficient that when disconnected from said well equipment the lower portion of said riser pipe means is containable within said well casing during lateral displacement of said platform means relative to said well under unfavorable environmental conditions above the seabed formation;

a hawse pipe on said platform means for receiving the upper portion of said riser pipe means;

guide means extending from the lower portion of said hawse pipe means;

and means on said platform means to receive and position said guide means for aligning said hawse pipe means in said platform means.

22. In an offshore apparatus including a floating platform means having means adapted to be connected to the upper end of a riser means, the combination of:

well means below said platform means;

said well means having a well casing extending into a seabed formation;

riser pipe means extending from said platform means into said well casing and adapted to be releasably connected to well equipment located down hole of said well casing;

said riser pipe means extending into said well casing a distance sufficient that when disconnected from said well equipment the lower portion of said riser pipe means is containable within said well casing during lateral displacement of said platform means relative to said well under unfavorable environmental conditions above the seabed formation;

a hawse pipe on said platform means for receiving the upper portion of said riser pipe means;

guide means associated with said hawse pipe means for positioning and aligning said hawse pipe means in said platform means;

a well template means seated on said sea floor and having a plurality of conductor pipes associated with each of said well casing means;

and means for aligning each riser pipe means with its respective well casing means;

whereby said hawse pipe means on said platform means and said conductor pipes on said well template means may be readily aligned with the associated riser pipe means.

23. In an offshore apparatus including a floating platform means having means adapted to be connected to the upper end of a riser means, the combination of:

well means below said platform means;

said well means having a well casing extending into a seabed formation;

riser pipe means extending from said platform means into said well casing and adapted to be releasably connected to well equipment located down hole of said well casing;

said riser pipe means extending into said well casing a distance sufficient that when disconnected from said well equipment the lower portion of said riser pipe means is containable within said well casing during lateral displacement of said platform means relative to said well under unfavorable environmental conditions above the seabed formation;

said well equipment means includes production control means;

a riser connector means on said riser pipe means;

said riser connector means and said production control means being releasably interconnectible in said down hole location.

24. In an offshore apparatus including a floating platform means having means adapted to be connected to the upper end of a riser means, the combination of:

well means below said platform means;

said well means having a well casing extending into a seabed formation;

riser pipe means extending from said platform means into said well casing and adapted to be releasably connected to well equipment located down hole of said well casing;

said riser pipe means extending into said well casing a distance sufficient that when disconnected from said well equipment the lower portion of said riser pipe means is containable within said well casing during lateral displacement of said platform means relative to said well under unfavorable environmental conditions above the seabed formation;

said well equipment means includes production control means;

a riser connector means on said riser pipe means;

said riser connector means and said production control means being releasably interconnectible in said down hole location;

said riser pipe means being separable at said riser connector means from said production control means;

and fail-safe valves at said down hole location for shutting off flow of production fluid upon separation of said riser connector means from said production control means.

25. A composite riser pipe construction comprising in combination:

an elongated riser pipe adapted for extending between a platform means and a well casing means in a seabed formation and to extend below said seabed surface;

a plurality of buoyant cowl elements partially encircling said riser pipe means between said seabed surface and said platform means;

and control line means extending along said riser pipe means in the space provided by said partially encircling buoyant elements;

said control line means including an elongated arcuate body having longitudinal passageways for fluid conducting lines, said body having concentric surfaces and a width spanning the gap in said cowl elements.

26. In a method of protecting a riser system wherein a lower end portion of a riser pipe extends for a selected distance into a subsea well casing and is releasably connected to a production fluid control means located in the subsea formation including, the steps of:

releasing the lower end portion of said riser pipe from said fluid control means;

said fluid control means being operative upon such release to automatically close flow of fluid therethrough;

and allowing the lower end portion of said riser pipe to dangle in said well casing until environmental conditions allow reconnection of said riser pipe to said fluid control means.

27. In a method of protecting a riser system as claimed in claim 26 including the step of carrying fluid actuating means on said riser pipe whereby, upon reconnection of said pipe to said control means, said control means is actuated to operative condition.

28. In a method of protecting a riser system as claimed in claim 27, including the step of:

providing a riser connector means on the end of said riser pipe, connected with said fluid actuating means, and adapted to connect said fluid actuating means with said fluid control means.

29. In an offshore well apparatus, the combination of:

a platform means;

well means below said platform means;

said well means having a well casing extending into a seabed formation;

riser pipe means extending from said platform means into said well casing and adapted to be releasably connected to well equipment at a selected depth below the surface of the seabed formation;

fluid control means below the lower end of said riser pipe means;

riser connector means interconnecting the riser pipe means and the fluid control means;

said fluid control means including fail-safe valve means;

a tubing string extending below said fluid control means;

said fail-safe valve means being operable to shut off flow of fluid below said riser connector means whereby said riser pipe means may be disconnected from said fluid control means at said riser connector means while maintaining the fluid flow under control by said fluid control means.

30. In an apparatus as claimd in claim 29 wherein said well casing includes an inner casing, a casing string within said inner casing, and a tubing string within said casing string;

a retrievable packer means in said casing means below said inner casing;

and a fail-safe valve means in said tubing string at the lower portion of said inner casing.

31. In an apparatus as stated in claim 29 wherein said well casing includes an inner casing having a relatively thick section extending from the surface of said sub seabed formation through the location of said fluid control means.

32. In an offshore well apparatus including a floating platform means adapted to be located above a well template mens and a riser pipe means extending between said floating platform means in said well template means; the combination of:

said platform means having a platform deck and a submerged structure;

a hawse pipe means extending between said platform deck and said submerged structure;

and means for positioning the hawse means at said submerged structure for alignment of said riser pipe means with respect to said platform means and well template means;

said positioning means for the hawse means including frame members defining polygonal openings in said submerged structure;

and means carried by said hawse pipe means for engagement with said frame members for locating said hawse pipe with its longitudinal axis coincident with the selected axis in said polygonal opening.

33. In an offshore well apparatus including a floating platform means adapted to be located above a well template means and riser pipe means extending between said floating platform means and said well template means; the combination of:

said platform means having a platform deck and a submerged structure;

a hawse pipe means extending between said platform deck and said submerged structure;

and means for positioning the hawse means at said submerged structure for alignment of said riser pipe means with respect to said platform means and well template means;

said hawse pipe means receives the upper end portion of said riser pipe means;

the portion of said riser pipe means within said hawse pipe means being provided with a plurality of adjacent collar means for contact with said hawse pipe during relative longitudinal and lateral movement of the upper portion of the riser means with respect to said hawse pipe means.

* * * * *

UNITED STATES PATENT AND TRADEMARK OFFICE

CERTIFICATE OF CORRECTION

PATENT NO. : 4,126,183

DATED : November 21, 1978

INVENTOR(S) : Raymond W. Walker

It is certified that error appears in the above-identified patent and that said Letters Patent are hereby corrected as shown below:

Column 1, lines 15 and 16, change "construciton" to -- construction --; line 21, change "will" to -- with --. Column 5, lines 27 and 28, delete "extending therebetween and connected to the lower hawse portion 41". Column 6, line 34, "Subsea Template Means" should be a subtitle above the paragraph. Column 8, line 34, change "as" to -- an --; line 56, change "130'" to -- 130 --; line 60, change "130'" to -- 121 --. Column 10, line 56, change "the" 1st occ. to -- to --. Column 11, line 5, change "passagways" to -- passageways --. Column 14, line 50, change "rise" to -- riser --. Column 18, line 49, change "mens" to -- means --. Column 23, line 24, change "mens" to -- means --.

Signed and Sealed this

Ninth Day of October 1979

[SEAL]

*Attest:*

RUTH C. MASON
*Attesting Officer*

LUTRELLE F. PARKER
*Acting Commissioner of Patents and Trademarks*